US009088069B2

(12) United States Patent
Bungo

(10) Patent No.: US 9,088,069 B2
(45) Date of Patent: Jul. 21, 2015

(54) WIRELESS COMMUNICATION APPARATUS

(75) Inventor: Akihiro Bungo, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 269 days.

(21) Appl. No.: 13/541,162

(22) Filed: Jul. 3, 2012

(65) Prior Publication Data

US 2013/0069836 A1 Mar. 21, 2013

Related U.S. Application Data

(60) Provisional application No. 61/537,109, filed on Sep. 21, 2011.

(51) Int. Cl.

| | |
|---|---|
| ***H01Q 1/24*** | (2006.01) |
| ***H01Q 1/52*** | (2006.01) |
| ***H01Q 21/28*** | (2006.01) |
| ***H01Q 25/00*** | (2006.01) |

(52) U.S. Cl.

CPC ..... *H01Q 1/243* (2013.01); *H01Q 1/521* (2013.01); *H01Q 21/28* (2013.01); *H01Q 25/00* (2013.01)

(58) Field of Classification Search

CPC ..... H01Q 1/243; H01Q 21/28; H01Q 1/521
USPC ..... 343/702, 767
See application file for complete search history.

(56) References Cited

U.S. PATENT DOCUMENTS

| | | | | |
|---|---|---|---|---|
| 7,164,898 | B2 * | 1/2007 | Hankui et al. | 455/311 |
| 8,483,751 | B2 * | 7/2013 | Black et al. | 455/552.1 |
| 2001/0043159 | A1 * | 11/2001 | Masuda et al. | 343/700 MS |
| 2003/0179143 | A1 * | 9/2003 | Iwai et al. | 343/702 |
| 2006/0181468 | A1 | 8/2006 | Iguchi et al. | |
| 2007/0194995 | A1 * | 8/2007 | Fang et al. | 343/702 |
| 2008/0007469 | A1 * | 1/2008 | Hung et al. | 343/702 |

(Continued)

FOREIGN PATENT DOCUMENTS

| | | | |
|---|---|---|---|
| CN | 201289902 | Y | 8/2009 |
| CN | 101730957 | A | 6/2010 |

(Continued)

OTHER PUBLICATIONS

Extended European Search Report issued Nov. 7, 2012, in European Patent Application No. 12180513.9.

(Continued)

*Primary Examiner* — Dieu H Duong
(74) *Attorney, Agent, or Firm* — Oblon, McClelland, Maier & Neustadt, L.L.P.

(57) ABSTRACT

A wireless communication apparatus that includes a first antenna section having a first power feed point; a second antenna section having a second power feed point; a first electrically conductive plate extending between the first antenna section and the second antenna section; a second electrically conductive plate disposed substantially in parallel with the first electrically conductive plate and extending between the first antenna section and the second antenna section; and a short-circuiting member that electrically short-circuits the first electrically conductive plate and the second electrically conductive plate to each other such that a slit is formed by a part of a periphery of the first electrically conductive plate and a part of a periphery of the second electrically conductive plate.

11 Claims, 31 Drawing Sheets

(56) References Cited

U.S. PATENT DOCUMENTS

| | | | | |
|---|---|---|---|---|
| 2009/0231215 | A1 | 9/2009 | Taura | |
| 2011/0057853 | A1 * | 3/2011 | Kim et al. | 343/843 |

FOREIGN PATENT DOCUMENTS

| | | | |
|---|---|---|---|
| CN | 102110900 | A | 6/2011 |
| JP | 2008-017047 | | 1/2008 |
| WO | WO 2011/101851 | A1 | 8/2011 |
| WO | WO 2011/105650 | A1 | 9/2011 |

OTHER PUBLICATIONS

Toru Okagaki, et al., "Reduction of Mutual Coupling in a Microstrip Patch Array Fed by a Triplate Waveguide with EBG Elements", IEICE Transactions on Electronics, vol. E89-C, No. 9, XP-001542408, Sep. 2006, pp. 1345-1347.

U.S. Appl. No. 13/713,099, filed Dec. 13, 2012, Bungo.

Combined Chinese Office Action and Search Report issued May 28, 2014 in Patent Application No. 201210318993.8 (with English language translation).

* cited by examiner

FIG. 11

| | PIN #1 | PIN #2 | PIN #3 | PIN #4 | PIN #5 | PIN #6 | ELEMENT 25 | ELEMENT 26 |
|---|---|---|---|---|---|---|---|---|
| #0 | ○ | ○ | ○ | ○ | ○ | ○ | 3.5 pF | 3.5 pF |
| #1 | ○ | × | ○ | ○ | ○ | ○ | 2.2 pF | 2.2 pF |
| #2 | × | ○ | ○ | ○ | ○ | ○ | 2.2 pF | 2.2 pF |
| #3 | ○ | × | ○ | × | × | × | 2.2 pF | 2.2 pF |
| #4 | ○ | × | ○ | ○ | × | ○ | 10 nH | 10 nH |

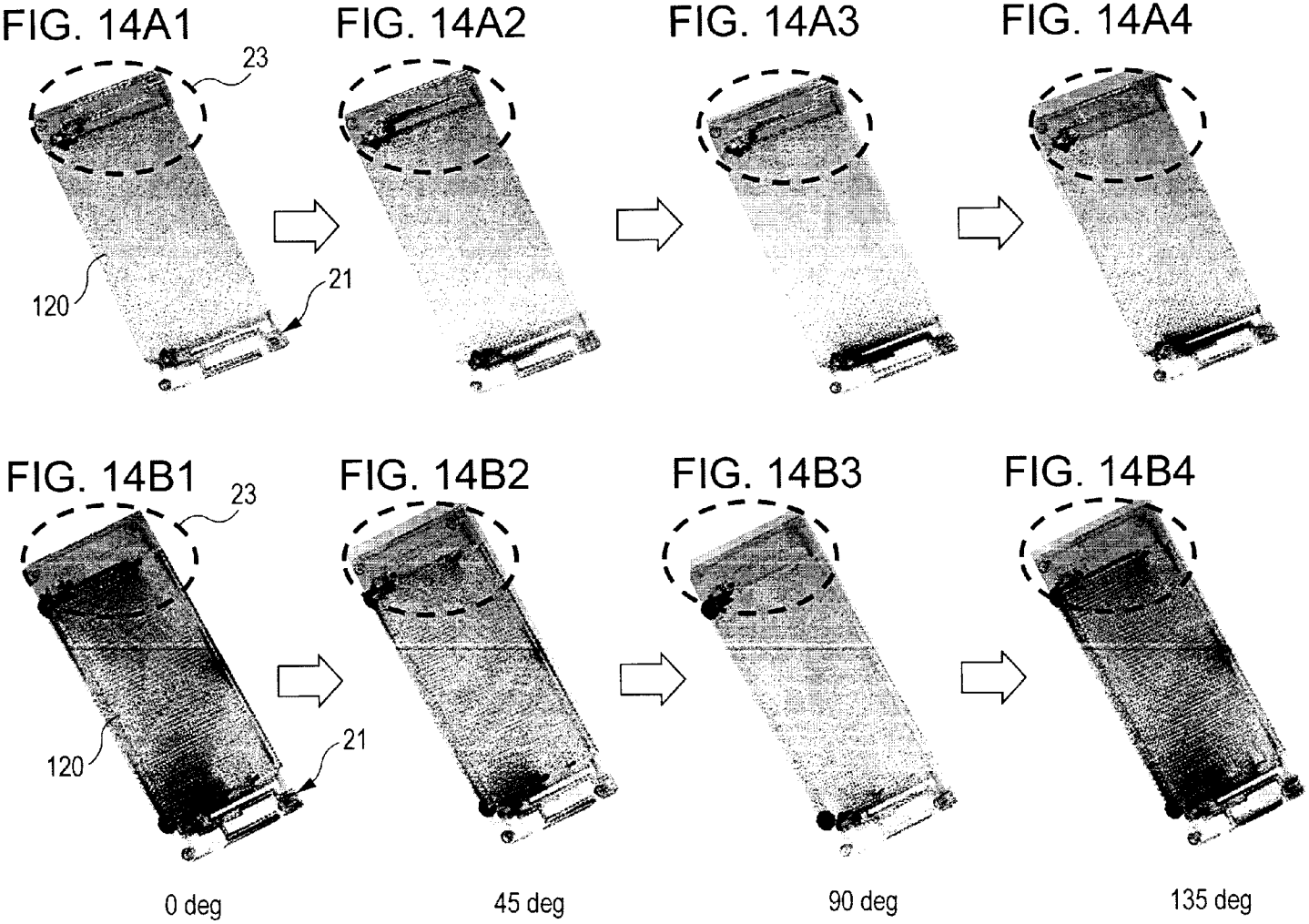
FIG. 14A1
23
21
120
FIG. 14A2
FIG. 14A3
FIG. 14A4
FIG. 14B1
23
21
120
0 deg
FIG. 14B2
45 deg
FIG. 14B3
90 deg
FIG. 14B4
135 deg FIG. 15B1
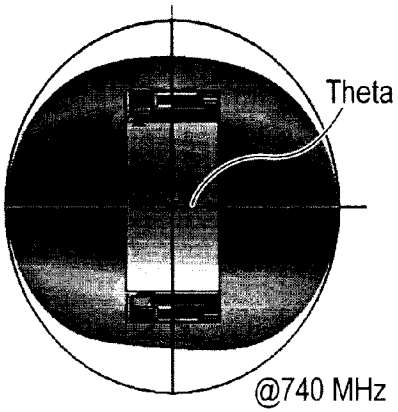
FIG. 15B2
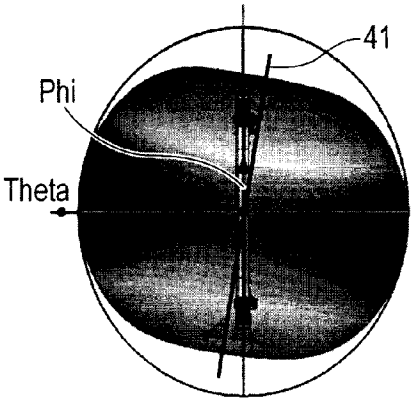
FIG. 15C1
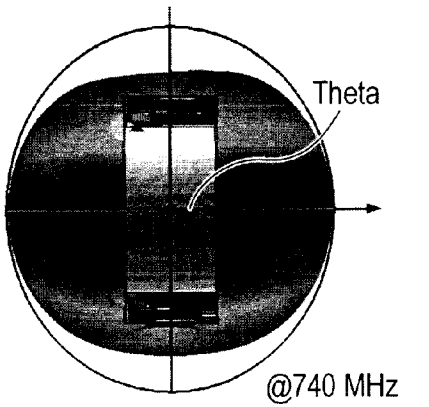
FIG. 15C2
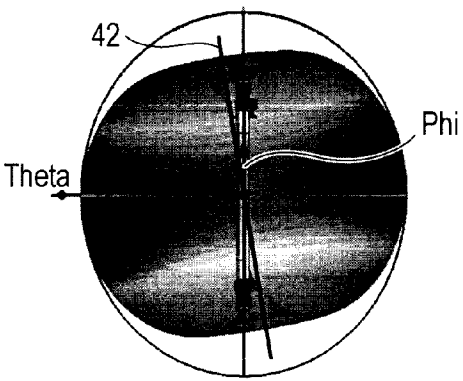
FIG. 15A
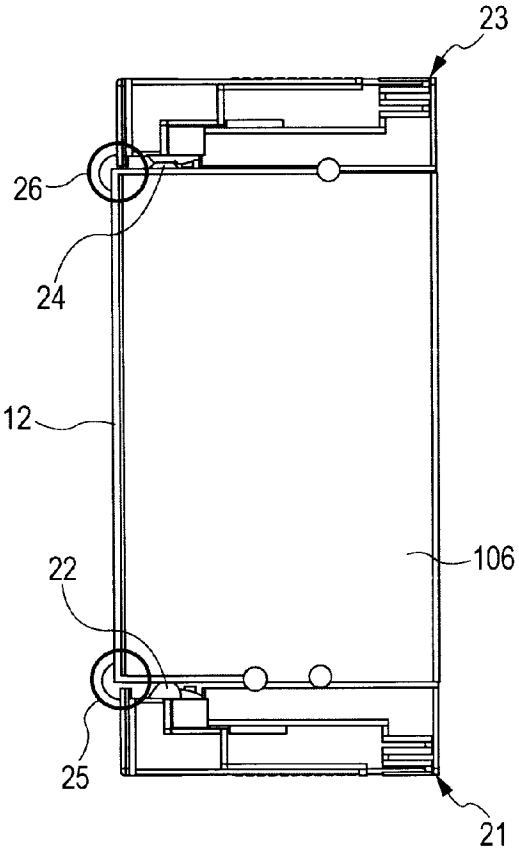

WIRELESS COMMUNICATION APPARATUS

CROSS REFERENCE TO RELATED APPLICATION

The present application claims the benefit of the earlier filing date of U.S. Provisional Patent Application Ser. No. 61/537,109 filed on Sep. 21, 2011, the entire contents of which is incorporated herein by reference.

BACKGROUND

1. Field of the Disclosure

The present disclosure relates to an antenna device, and relates in particular to (but is not limited to) a wireless communication apparatus that adopts a MIMO (Multi Input Multi Output) antenna device.

2. Description of Related Art

A service called "LTE" (Long Term Evolution) is known as one of specifications for high-speed data communication for cellular phones. When seen from a technical viewpoint for an antenna, the LTE has the following characteristics.

That is, the LTE is intended for a communication system called "MIMO", in which a plurality of antennas are used for transmission and reception to achieve high-speed data communication. A wireless communication apparatus such as a portable terminal that adopts the MIMO normally uses two antennas. It is desired that the two antennas should ideally have equal antenna characteristics.

An index called "correlation" between the antennas serves as a key point of the antenna characteristics for the MIMO. It is known that a large value (coefficient) of correlation (that is, a high degree of correlation) between the antennas reduces the communication speed.

The frequency band that is currently or planned to be used for the LTE service in various countries exists over a wide range, and it is desired that both a lower band and a higher band of an existing cellular system should be broadened.

For example, in a service in 700-MHz band in the United States, it is significantly difficult to reduce the correlation between the antennas. This is because a lower frequency causes a high-frequency current to flow through the entire substrate of a portable terminal, which brings the antennas into an operation mode similar to that of dipoles to make the directivity of the antennas less dependent on the design of the antennas. Hence, if it is attempted to improve the correlation by varying the directivity by changing the design of one of the antennas, it is considerably difficult to obtain desired results.

Japanese Unexamined Patent Application Publication No. 2008-17047 proposes a multi-antenna that can be applied to a mobile communication system that is less affected by mutual coupling. The multi-antenna includes a plurality of power feed elements respectively connected to a plurality of power feed points on a circuit substrate, and a single or a plurality of parasitic elements connected to the circuit substrate in the vicinity of an arbitrary power feed point.

SUMMARY

In a wireless communication apparatus such as a portable terminal that adopts the MIMO, as discussed above, it is desired that the antennas, the number of which is normally two, should ideally have equal antenna characteristics. However, connecting parasitic elements to the vicinity of a power feed element as in the related art described above may cause a difference in antenna efficiency. Thus, the related art described above is not suitable for the MIMO, for which antennas with an equal antenna efficiency are ideally preferable.

Against such background, the inventor recognizes the need for a wireless communication apparatus including an antenna device in which a plurality of antennas have a low degree of correlation and a balanced antenna efficiency.

According to an embodiment of the present disclosure, there is provided a wireless communication apparatus that includes a first antenna section having a first power feed point; a second antenna section having a second power feed point; a first electrically conductive plate extending between the first antenna section and the second antenna section; a second electrically conductive plate disposed substantially in parallel with the first electrically conductive plate and extending between the first antenna section and the second antenna section; and a short-circuiting member that electrically short-circuits the first electrically conductive plate and the second electrically conductive plate to each other such that a slit is formed by a part of a periphery of the first electrically conductive plate and a part of a periphery of the second electrically conductive plate.

The first and second electrically conductive plates form the predetermined slit therebetween to provide a function equivalent to that of a slit antenna. The interposition of such a slit antenna between the first and second electrically conductive plates reduces the correlation between the first and second antenna sections.

By effectively utilizing existing components provided in the wireless communication apparatus as the first and second electrically conductive plates, it is possible to provide a wireless communication apparatus with desired antenna characteristics at a low cost.

BRIEF DESCRIPTION OF DRAWINGS

FIG. 11 is another diagram illustrating specific examples of the number of the short-circuiting members and the values of the elements used in the portable terminal according to the embodiment of the present disclosure.

FIGS. 14(*a*1) to 14(*a*4) and 14(*b*1) to 14(*b*4) show the current distribution in a main antenna, a sub antenna, and a GND plate which is common to the two antennas when power is fed to the main antenna in the case where a slit is not utilized and in the case where a slit is utilized, respectively.

FIGS. 15(*a*), 15(*b*1), 15(*b*2), 15(*c*1) and 15(*c*2) show a portable terminal with a slit, and a radiation pattern as seen from the front surface and the side surface, respectively, of the portable terminal in the case where power is fed to the sub antenna.

DETAILED DESCRIPTION

Embodiments of the present disclosure will be described in detail below with reference to the drawings.

Figure 1A:
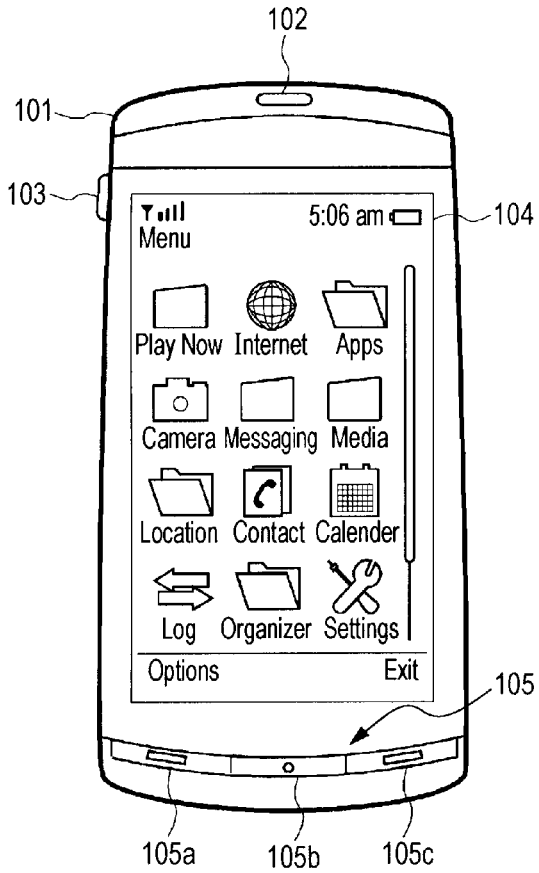
FIGS. 1(*a*) and 1(*b*) show the appearance of the front surface and the back surface, respectively, of a portable terminal serving as an example of a wireless communication apparatus according to an embodiment of the present disclosure.
Figure 1B:
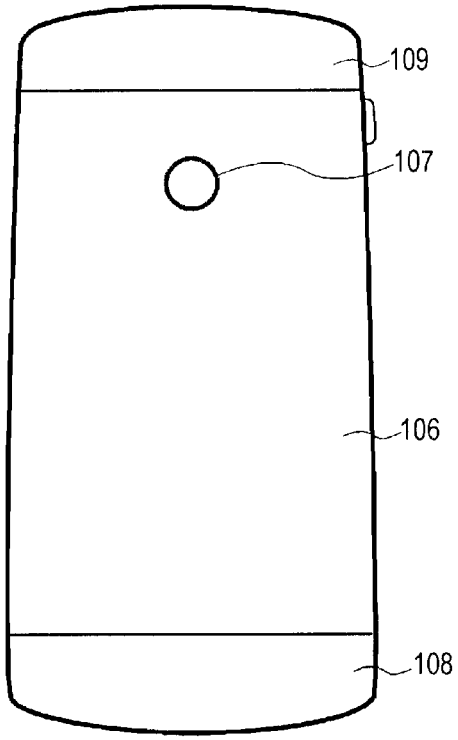

FIGS. 1(*a*) and 1(*b*) show the appearance of the front surface and the back surface, respectively, of a portable terminal, such as that called "smartphone", serving as an example of a wireless communication apparatus according to an embodiment of the present disclosure. The portable terminal has a housing 101 having a substantially rectangular parallelepiped outer shape.

A display screen 104 of a display device such as an LCD is provided on the front surface side of the portable terminal shown in FIG. 1(*a*). A speaker section 102 is disposed on the upper side of the display screen 104. An operating section 105 including operating keys 105*a* to 105*c* is disposed on the lower side of the display screen 104.

As well shown in FIG. 1(*b*), the portable terminal includes a main antenna section 108 serving as a first antenna section at the lower end of the portable terminal, and a sub antenna section 109 serving as a second antenna section disposed apart from the main antenna section 108 at the upper end of the portable terminal. A housing panel 106 is disposed between the main antenna section 108 and the sub antenna section 109 on the back surface of the portable terminal. The housing panel 106 forms a first electrically conductive plate to be discussed later. In the example, the housing panel 106 also serves as a battery lid. However, the housing panel 106 does not necessarily serve as a battery lid. The housing panel 106 is formed from an electrically conductive metal material. Alternatively, the housing panel 106 may be formed by covering a plastic material with an electrically conductive layer or by having an electrically conductive layer embedded in a plastic material. A circular opening formed at the center of the upper portion of the housing panel 106 indicates a camera section 107. It should be noted, however, that the camera section 107 is not an essential element of the present disclosure.

Figure 2:
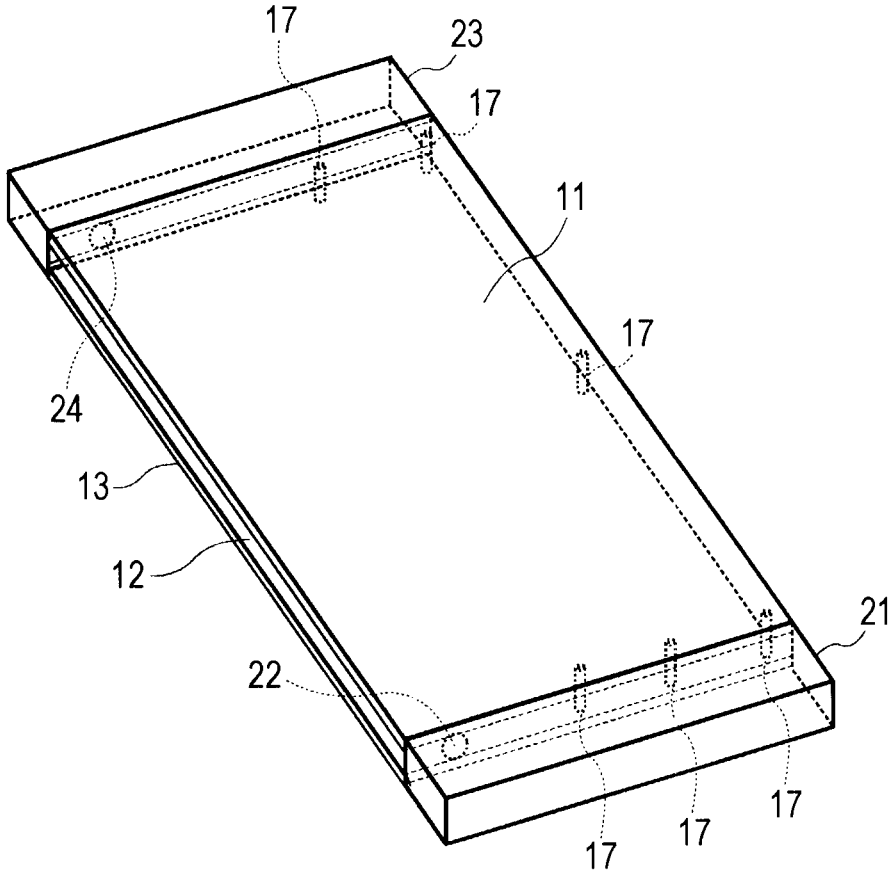
FIG. 2 shows a simplified configuration of an antenna device of the portable terminal according to the embodiment of the present disclosure.

FIG. 2 shows a simplified configuration of an antenna device of the portable terminal according to the embodiment. The portable terminal includes a main antenna 21 forming the first antenna section at the lower end of the portable terminal, and a sub antenna 23 forming the second antenna section disposed apart from the main antenna 21 at the upper end of the portable terminal. In the embodiment, the main antenna 21 and the sub antenna 23 form a MIMO antenna device. A first electrically conductive plate 11 extends between the main antenna 21 and the sub antenna 23. A second electrically conductive plate 13 extends substantially in parallel with the first electrically conductive plate 11 between the main antenna 21 and the sub antenna 23. The electrically conductive plate 11 and the electrically conductive plate 13 are electrically connected to each other by a plurality of short-circuiting members 17 provided over a range corresponding to substantially half the peripheral portions of the electrically conductive plates 11 and 13. Here, the short-circuiting members 17 are assumed to be electrically conductive pins of any shape and size. The short-circuiting members 17 may be contact members such as an electrically conductive plate-like member or electrically conductive springs. In the case where such contact members are used, spring structures may be provided on the side of the housing panel 106, or plate springs may be provided on the side of the opposing member.

The electrically conductive plate 13 serves as a GND plate (GND plane) that is common to the two antennas. Respective GNDs of the main antenna 21 and the sub antenna 23 are connected to the electrically conductive plate 13.

Figure 3A:
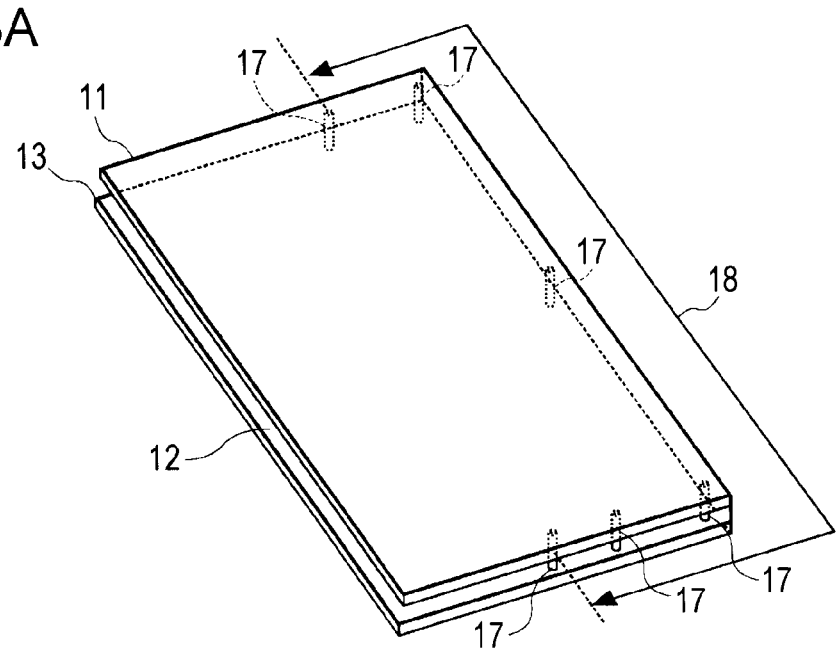
FIGS. 3(*a*) and 3(*b*) illustrate the configuration of first and second electrically conductive plates according to the embodiment of the present disclosure.
Figure 3B:
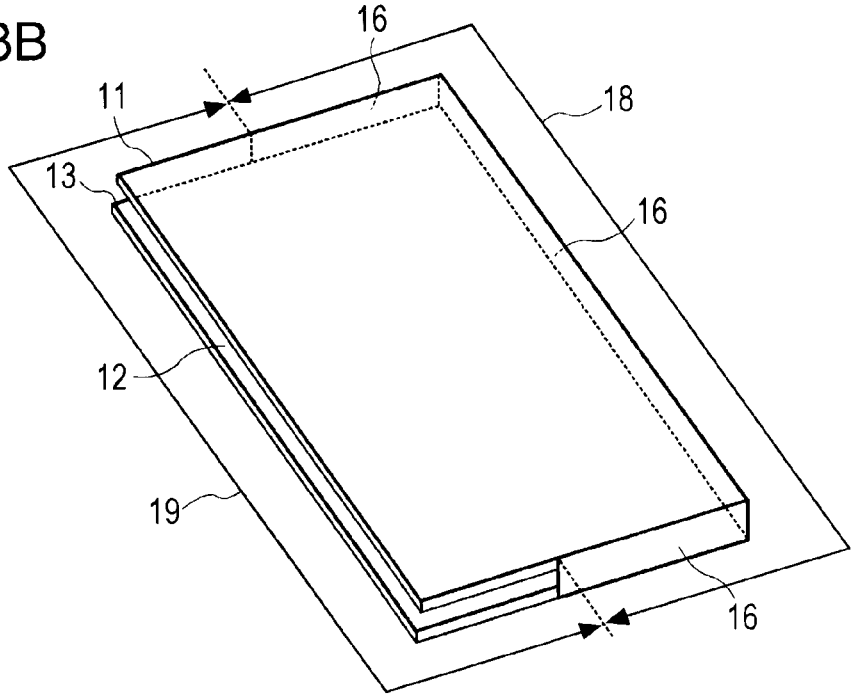

As shown in FIG. 3(*a*), which shows the two electrically conductive plates 11 and 13 as extracted, the short-circuiting members 17 are disposed at both ends of a range 18, which is a part of the peripheries of the two electrically conductive plates, and a single or a plurality of positions between the ends. The interval between adjacent short-circuiting members 17 is set to be less than a predetermined value such that the resonance frequency of a slit antenna formed by a slit corresponding to the interval is sufficiently higher than the frequency used by the portable terminal. For example, in the case where the short-circuiting members 17 are electrically conductive pins, a plurality of electrically conductive pins are disposed at intervals that are narrower than the predetermined interval along the peripheries of the first and second electrically conductive plates other than the region of the intended slit. This configuration is considered to be equivalent, in terms of frequency of use, to a configuration in which the range 18 of the peripheries of the two electrically conductive plates is entirely covered with solid electrically conductive plates 11 as shown in FIG. 3(*b*). As a result, a slit 12 is formed by a gap between the edges of the two electrically conductive plates 11 and 13 over a range 19 of the peripheries of the two electrically conductive plates. In other words, the short-circuiting members 17 electrically short-circuit the first electrically conductive plate and the second electrically conductive plate to each other such that a predetermined slit is formed by a part of the periphery of the first electrically conductive plate and a part of the periphery of the second electrically conductive plate opposing each other. This configuration is considered to be equivalent to a slit antenna in which a predetermined slit is formed in a single electrically conductive plate. The length of the slit is set to be substantially half the wavelength ($\lambda/2$) of the frequency of the antenna device used by the portable terminal.

The width of the slit 12 may be not constant over the entire length of the slit 12 in the longitudinal direction.

Returning to FIG. 2, a power feed point 22 of the main antenna 21 and a power feed point 24 of the sub antenna 23 are disposed in the vicinity of the slit 12, preferably at positions facing the gap of the slit 12.

Figure 4A:
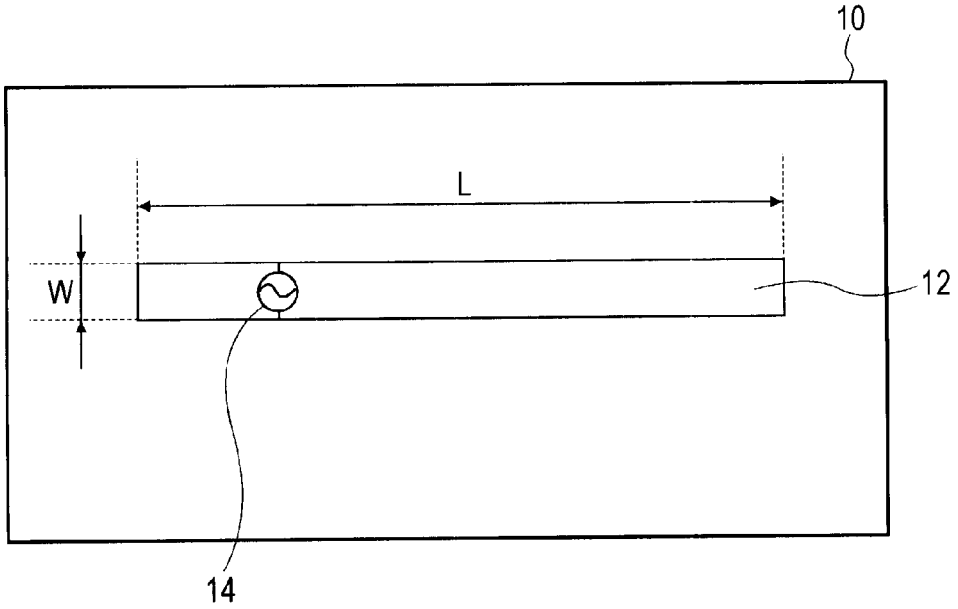
FIGS. 4(*a*) and 4(*b*) illustrate a known slit antenna (or slot antenna).
Figure 4B:
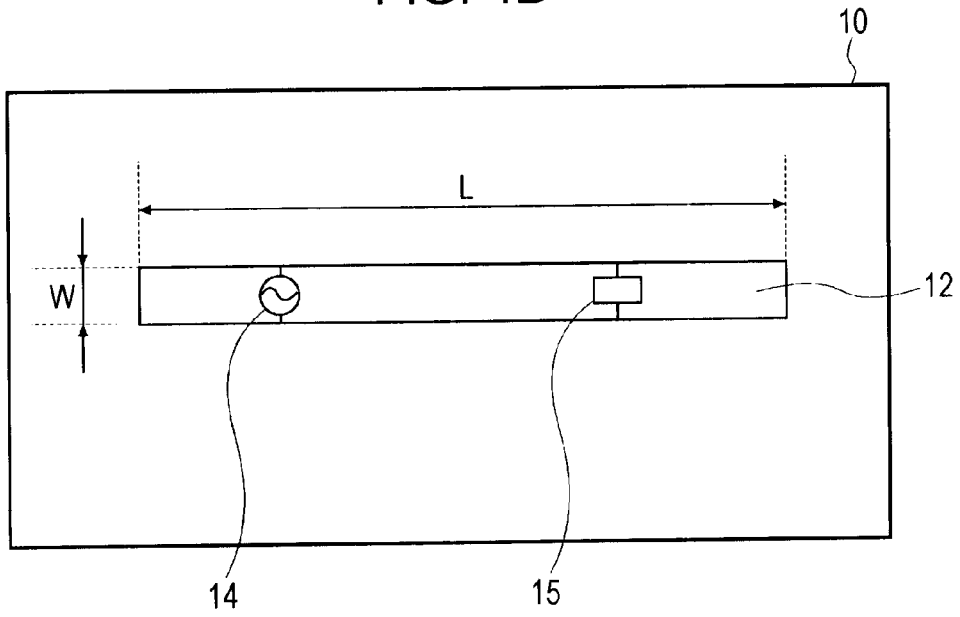

Here, in order to better understand the embodiment, a known slit antenna (or a slot antenna) will be described with reference to FIGS. 4(*a*) and 4(*b*). As shown in FIG. 4(*a*), a conductive plate 10 is provided with a thin and long slit (or slot) 12, and an alternating voltage with a frequency, half the wavelength of which corresponds to the length of the slit, is applied between the edges of the slit 12. It is known that the conductive plate 10 produces radiation of an electromagnetic field to function as an antenna. The resonance frequency of the slit antenna depends on the length L of the slit 12. The width W of the slit 12 may also affect the resonance frequency. As shown in FIG. 4(*b*), an element 15 which is an electronic component may be inserted between the edges of the slit 12 to adjust the resonance frequency of the slit antenna. In the example, the element 15 is a passive element, and may be a reactive element such as an inductor with an inductive reactance or a capacitor with a capacitive reactance, for example. The resonance frequency of the slit antenna may be adjusted to be increased by an inductor and decreased by a capacitor.

Figure 5:
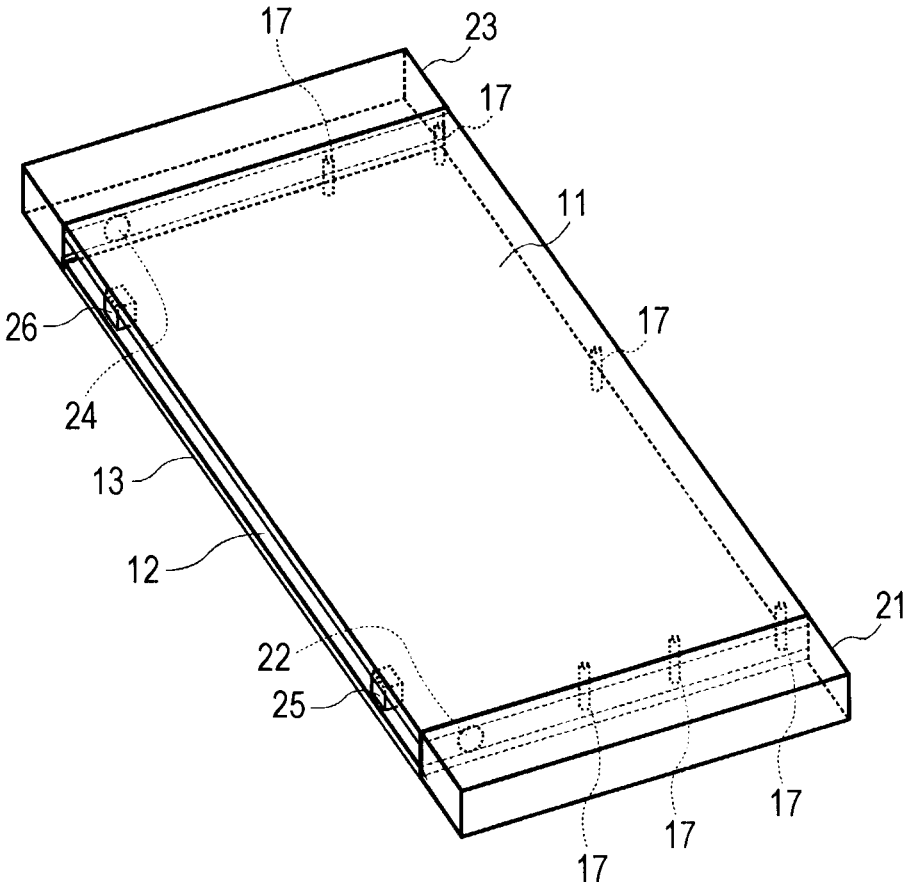
FIG. 5 shows a modification of the configuration shown in FIGS. 3(*a*) and 3(*b*).
Figure 6A:
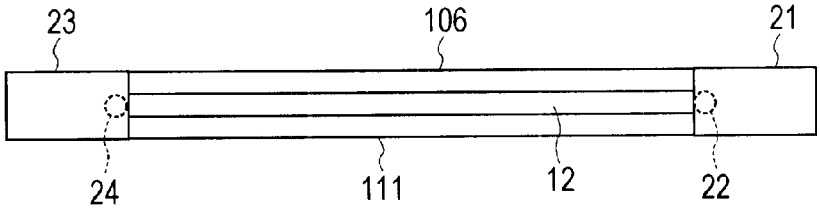
FIGS. 6(*a*) to 6(*d*) show four main aspects of the combination of elements forming a slit according to the embodiment of the present disclosure.
Figure 6B:
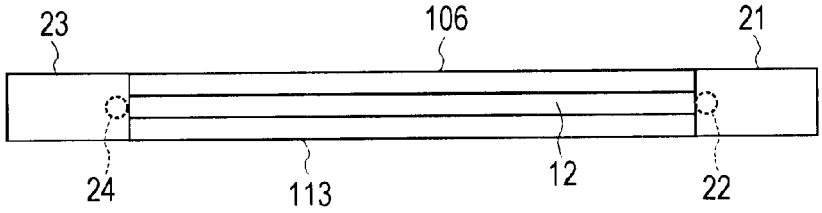
Figure 6C:
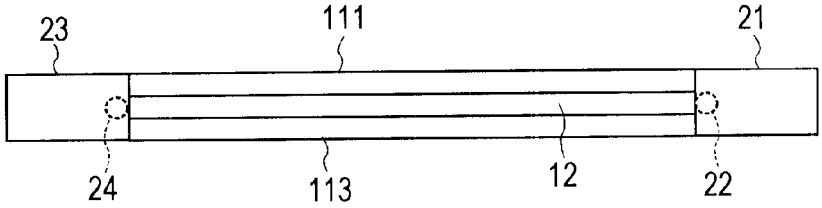
Figure 6D:
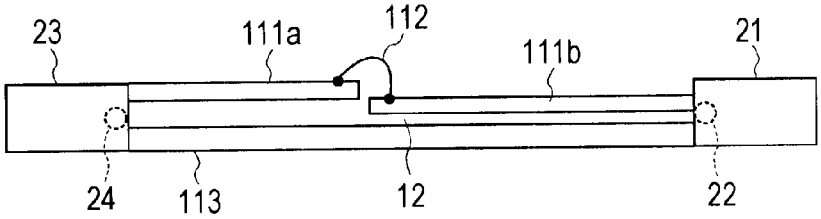

Also in the configuration shown in FIGS. 3(*a*) and 3(*b*), as shown in FIG. 5, elements 25, 26 which are reactive elements such as inductors or capacitors, for example, may be provided to connect between the opposing edges of the slit 12, at a point on the side of the main antenna 21 of the slit 12 and at a point on the side of the sub antenna 23 of the slit 12. By choosing the values of such elements, the resonance frequency of the slit antenna formed by the slit 12 may be adjusted as illustrated in relation to FIG. 4(*b*). It should be noted, however, that use of the elements 25, 26 is not essential to the present disclosure. The number of such elements is not limited to two.

FIGS. 6(*a*) to 6(*d*) show four main aspects of the combination of elements forming the slit 12 according to the embodiment.

FIG. 6(*a*) shows a first aspect in which the electrically conductive housing panel 106 discussed above is utilized as the first electrically conductive plate, and in which an electrically conductive layer (GND plate) formed in a printed circuit board (PCB) 111 is utilized as the second electrically conductive plate.

FIG. 6(*b*) shows a second aspect in which the electrically conductive housing panel 106 is utilized as the first electrically conductive plate, and in which a SUS plate 113 is utilized as the second electrically conductive plate. The SUS plate 113 is a metal plate made of stainless steel (Steel Use Stainless) and normally utilized for the purpose of reinforcing the LCD panel in the portable terminal etc, and is disposed substantially in parallel with the housing panel.

FIG. 6(*c*) shows a third aspect in which the electrically conductive layer (GND plate) formed in the PCB is utilized as the first electrically conductive plate, and in which the SUS plate 113 is utilized as the second electrically conductive plate.

FIG. 6(*d*) shows a fourth aspect in which electrically conductive layers (GND plates) formed in PCBs 111*a*, 111*b*, which are two half substrates, are utilized as the first electrically conductive plate, and in which the SUS plate 113 is utilized as the second electrically conductive plate. The electrically conductive layers in the two PCBs 111*a*, 111*b* are connected to each other by an electrically conductive coupling member 112. A wire is shown as an example of the electrically conductive coupling member 112. However, the electrically conductive coupling member 112 is not limited to a wire.

Figure 7A:
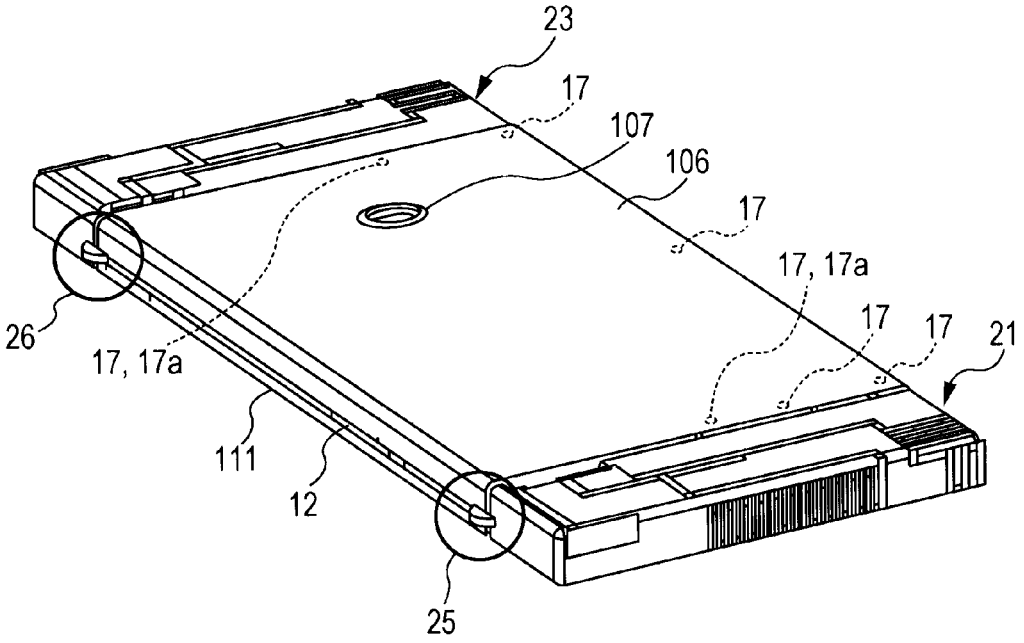
FIG. 7(*a*) is a perspective view showing a schematic appearance of a portable terminal according to a first aspect shown in FIG. 6, and FIG. 7(*b*) shows a slit of the portable terminal as extracted.
Figure 7B:
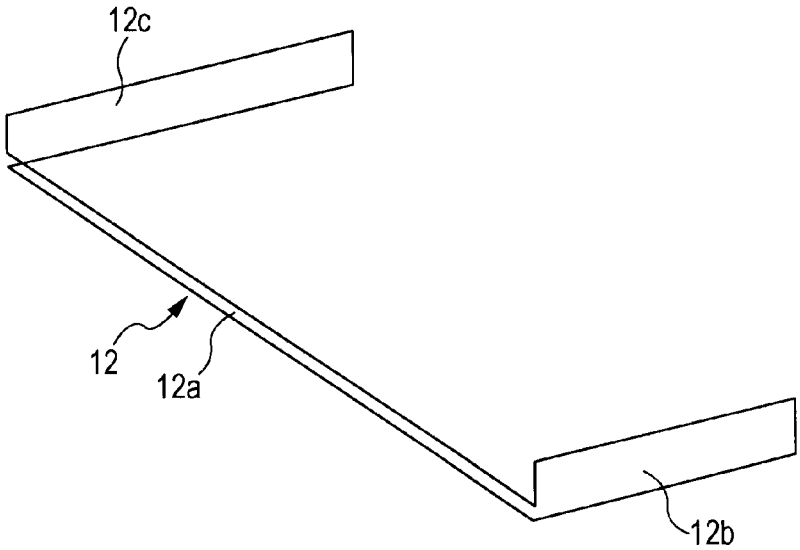
Figure 8A:
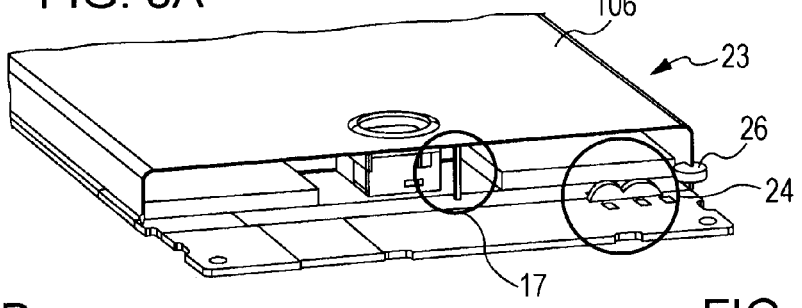
FIGS. 8(*a*) to 8(*e*) show an example of a specific configuration of the portable terminal shown in FIG. 7(*a*).
Figure 8B:
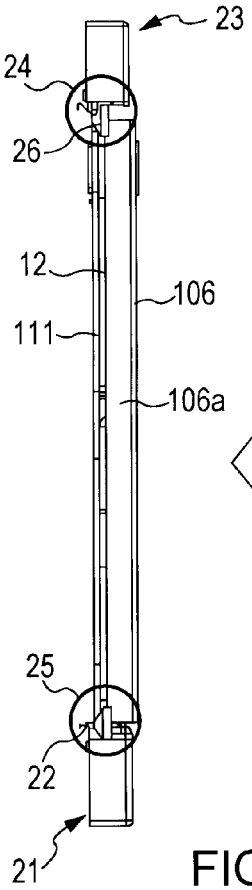
Figure 8C:
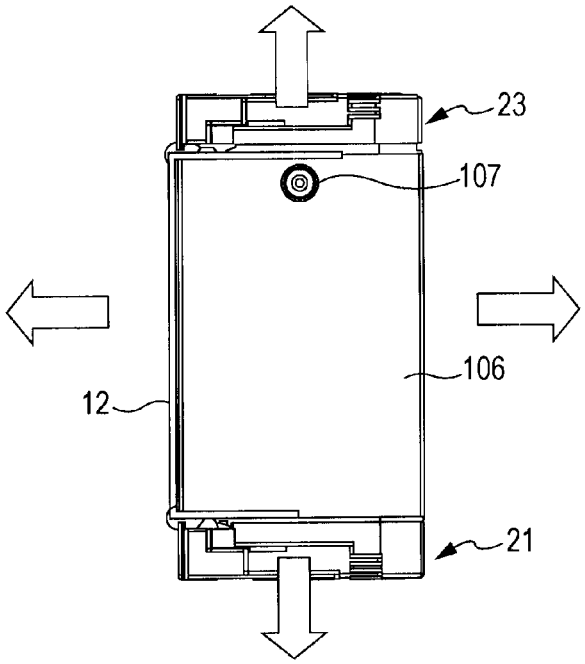
Figure 8E:
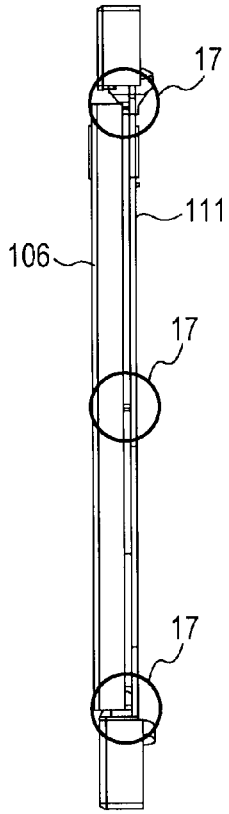
Figure 8D:
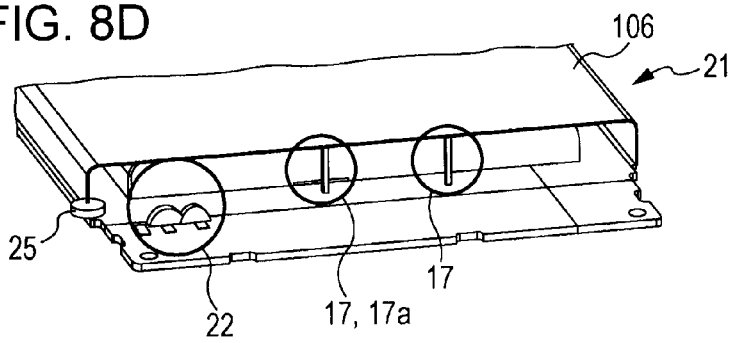

FIG. 7(*a*) is a perspective view showing a schematic appearance of a portable terminal according to the first aspect discussed above. As illustrated in relation to FIG. 2, the portable terminal has a substantially rectangular parallelepiped outer shape, and includes the main antenna 21 serving as the first antenna section at the lower end of the portable terminal, and the sub antenna 23 serving as the second antenna section disposed apart from the main antenna 21 at the upper end of the portable terminal. The housing panel 106 serving as the first electrically conductive plate 11 extends between the main antenna 21 and the sub antenna 23 disposed apart from each other at the upper end and lower end, respectively, of the terminal. The PCB 11 (the electrically conductive layer thereof) serving as the second electrically conductive plate 13 extends substantially in parallel with the housing panel 106 between the main antenna 21 and the sub antenna 23. As illustrated in relation to FIG. 3(*a*), the housing panel 106 and the electrically conductive layer of the PCB 111 are electrically connected to each other by the plurality of short-circuiting members 17 provided over a range corresponding to substantially half the peripheral portions of the housing panel 106 and the electrically conductive layer of the PCB 111. The slit 12 is formed between the housing panel 106 and the electrically conductive layer of the PCB 111.

The contour of the slit 12 is extracted and shown in FIG. 7(*b*). The slit 12 extends not only along a side portion of the portable terminal but also in the direction that is orthogonal to the longitudinal direction of the side portion. Thus, the overall length of the slit 12 varies depending on the positions of the outermost short-circuiting members 17. In the example shown, the slit 12 includes a side portion 12*a* and a lower end portion 12*b* and an upper end portion 12*c* that communicate with the side portion 12*a*, in correspondence with the configuration of the housing panel 106. The width of the lower end portion 12*b* and the upper end portion 12*c* is larger than the width of the side portion 12*a*. A loop of edges defining the slit 12 is formed by the edges of two outermost short-circuiting members 17*a*, of the group of short-circuiting members 17, the edge of the housing panel 106 connected to the edges of the short-circuiting members 17*a* over a range in which no short-circuiting members 17 are provided, and the edge of the electrically conductive layer of the PCB 111 opposing the edge of the housing panel 106 over such a range.

Although not shown, the main antenna 21 and the sub antenna 23 are covered by housing portions that are separate from each other. Other elements such as an LCD device forming a display section are disposed on the front surface side of the PCB 111 in FIG. 7(*a*) (on the back side of the portable terminal shown in FIG. 7(*a*)).

FIGS. 8(*a*) to 8(*e*) show an example of a specific configuration of the portable terminal shown in FIG. 7(*a*). FIGS. 8(*c*), 8(*b*), and 8(*e*) are a front view, a left side view, and a right side view, respectively, of an essential portion of the portable terminal. FIG. 8(*d*) is an enlarged perspective view of the main antenna portion at the lower end of the portable terminal. FIG. 8(*a*) is an enlarged perspective view of the sub antenna portion at the upper end of the portable terminal. FIGS. 8(*a*) to 8(*e*) are not to scale for convenience of illustration.

In this aspect, the electrically conductive housing panel 106 is utilized as the first electrically conductive plate, and the electrically conductive layer (GND plate) formed in the printed circuit board (PCB) 111 is utilized as the second electrically conductive plate. The slit 12 is formed between the housing panel 106 and the printed circuit board (PCB) 111. In the example shown, as shown in FIG. 8(*b*), the housing panel 106 includes a thin and long side portion 106*a* that is bent inward at a substantially right angle from the main flat surface of the housing panel 106. It should be noted, however, that the side portion 106*a* is not an essential element of the present disclosure. The width of the slit 12 may vary depending on the presence or absence of the side portion 106*a*. Such variations in width of the slit may be accommodated by adjusting the length of the slit 12 and choosing the values of the elements 25, 26.

Figure 9:
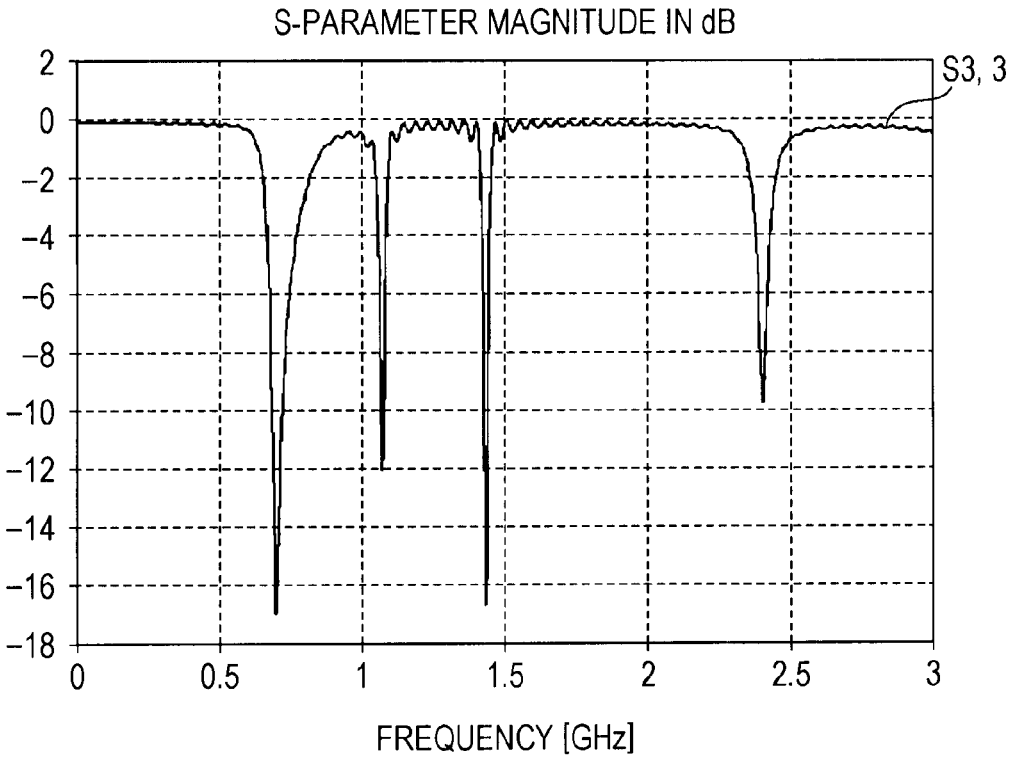
FIG. 9 shows the antenna characteristics of a slit antenna formed by a slit 12 shown in FIG. 8(*c*).

FIG. 9 is a graph showing the antenna characteristics of the slit antenna in the case where power is fed to the slit 12 shown in FIG. 8(*c*). The antenna characteristics have been obtained on the basis of simulation results. The graph is provided to check whether or not a ground current flowing through the slit 12 resonates at a desired frequency when power is fed to the main antenna 21 and the sub antenna 23 although power is not actually fed to the slit 12. In the graph, the horizontal axis indicates the frequency [GHz], and the vertical axis indicates the reflection characteristics [dB]. S3,3 indicates the reflection characteristics of a third antenna, here a virtual slit antenna. For convenience, the graph shows the results of measuring the characteristics of the slit antenna using the position of the short-circuiting member 17*a* shown in FIG. 8(*d*) as a power feed point. It is found from the graph that the slit antenna has several resonance frequencies. The resonance frequencies include 700-MHz band.

Figure 10:
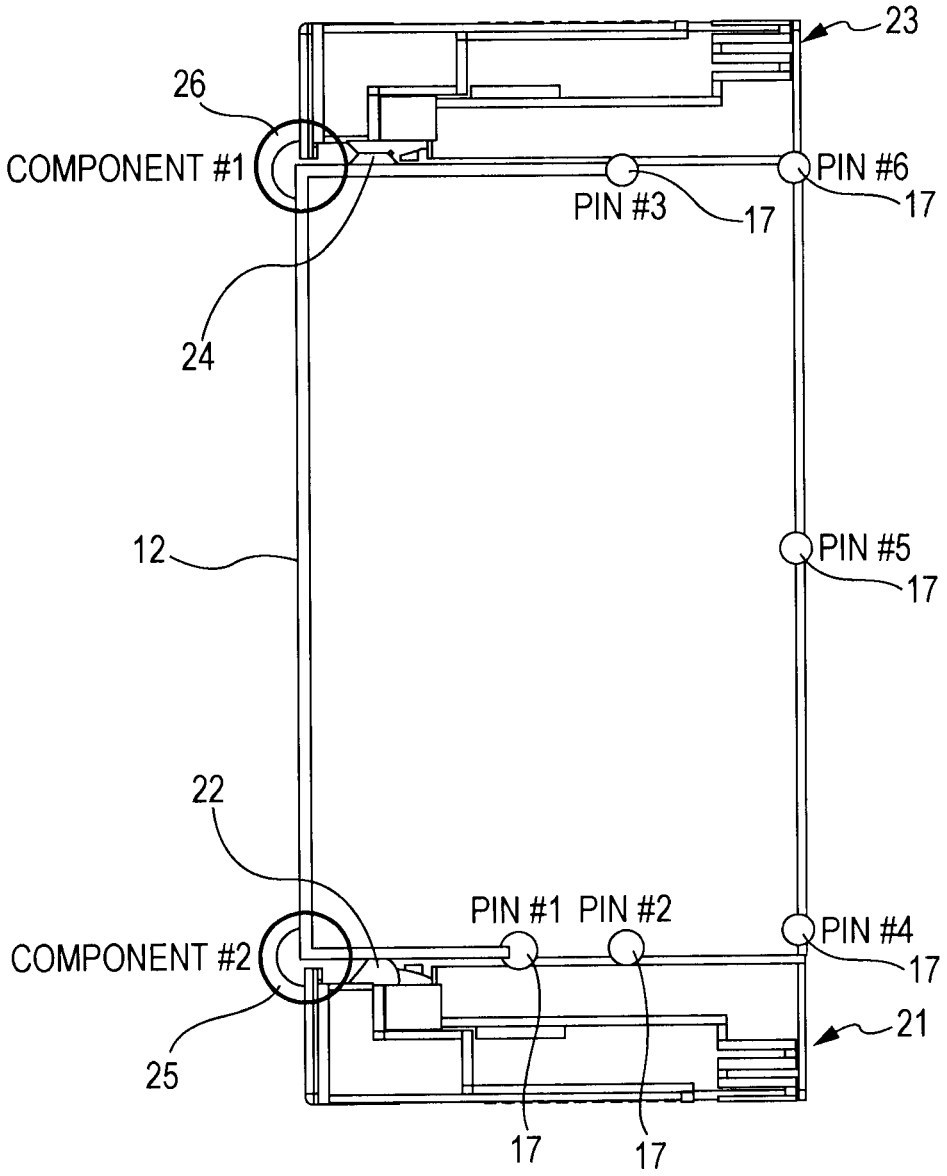
FIG. 10 is a diagram illustrating specific examples of the number of short-circuiting members and the values of elements used in the portable terminal according to the embodiment of the present disclosure.

Specific examples of the number of the short-circuiting members 17 (in the example, electrically conductive pins) and the values of the elements 25, 26 used in the portable terminal according to the embodiment will be described with reference to FIGS. 10 and 11. FIG. 10 shows the configuration of the portable terminal shown in FIG. 8(*c*) again, with the pins serving as the short-circuiting members 17 and the elements 25, 26 numbered for differentiation between each other. The slit 12 is actually not seen in a plan view of the portable terminal such as that shown. In order to indicate the position and the length of the slit 12, however, the slit 12 is indicated by a thick line for convenience.

FIG. 11 shows five configuration examples (models) that may be adopted in the embodiment for the pins #1 to #6 and the elements #1 and #2 in the portable terminal shown in FIG. 10 and their values. The model #0 serving as the reference includes all the pins #1 to #6 shown in FIG. 10, and uses a capacitor of 3.5 pF as the elements 25, 26. In FIG. 11, the "○" mark and the "x" mark in a pin field indicate the presence and absence, respectively, of the corresponding pin.

The model #1 includes the pin #1 and the pins #3 to #6, with the pin #2 removed, and uses a capacitor of 2.2 pF as the elements 25, 26.

The model #2 includes the pins #2 to #6, with the pin #1 removed, and uses a capacitor of 2.2 pF as the elements 25, 26.

The model #3 includes only the pin #1 and the pin #3, with the pins #2 and #4 to #6 removed, and uses a capacitor of 2.2 pF as the elements 25, 26.

The model #4 includes the pins #1, #3, #4, and #6, with the pins #2 and #5 removed, and uses an inductor of 10 nH as the elements 25, 26.

As discussed above, the elements 25, 26 are not necessarily essential elements.

Figure 12:
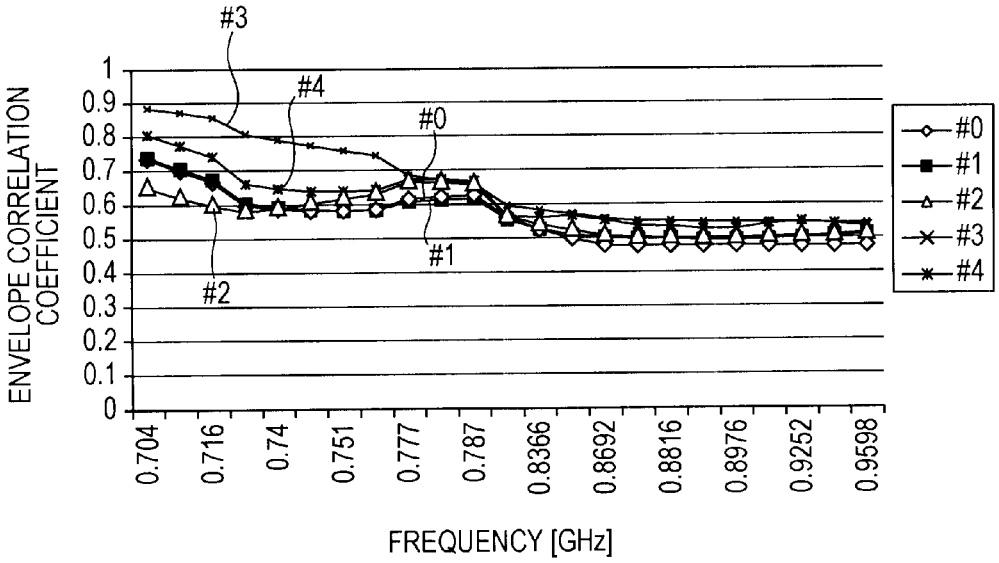
FIG. 12 is a graph showing the envelope correlation coefficient (Envelope correlation coefficient: ECC) for various models of portable terminal according to the embodiment of the present disclosure.
Figure 13A:
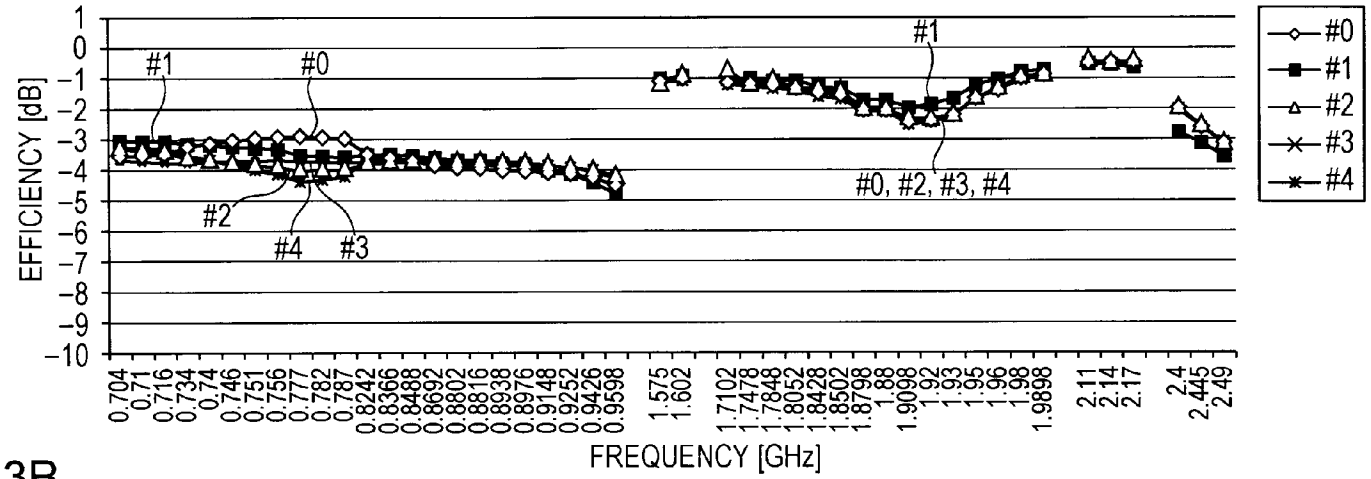
FIGS. 13(*a*) and 13(*b*) are graphs showing the frequency characteristics of the efficiency of a main antenna section (Bottom) and the efficiency of a sub antenna section (Top), respectively.
Figure 13B:
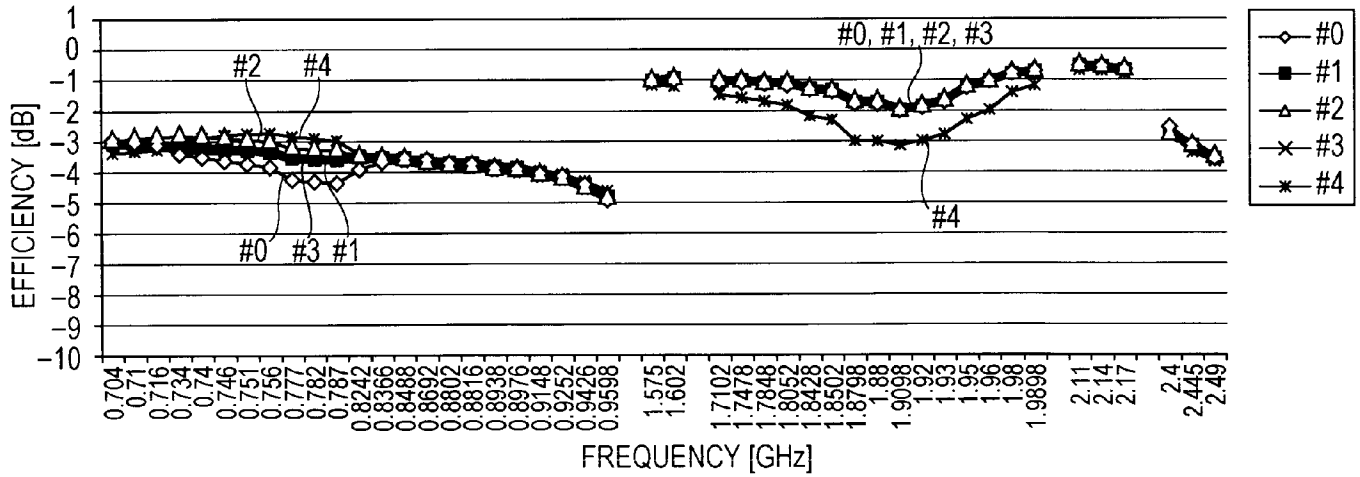

FIG. 12 is a graph showing the envelope correlation coefficient (Envelope correlation coefficient: ECC) for the model #0 (reference) and the models #1 to #4. FIGS. 13(*a*) and 13(*b*) are graphs showing the frequency characteristics of the efficiency of the main antenna section (Bottom) and the efficiency of the sub antenna section (Top), respectively. The graphs have been obtained on the basis of simulation results. Other graphs to be discussed later also have been obtained in the same way.

In FIG. 12, the graphs for the model #0 (reference) and the model #1 substantially coincide with each other. The model #3 and the model #4 (in particular, model #3) exhibit high correlation at frequencies lower than around 0.78 MHz. Thus, it is found that it is not preferable to remove all the pins #4 to #6 as in the model #3.

As shown in FIGS. 13(*a*) and 13(*b*), there are slight fluctuations in antenna efficiency among the models. However, the antenna efficiency is substantially balanced between the main antenna section (Bottom) and the sub antenna section (Top), and the values of the antenna efficiency for the two antenna sections are not specifically problematic.

FIGS. 14(*a*1) to 14(*a*4) and 14(*b*1) to 14(*b*4) show the current distribution in the main antenna 21, the sub antenna 23, and the GND plate which is common to the two antennas when power is fed to the main antenna 21 in the case where a slit is not utilized and in the case where a slit is utilized, respectively. In the drawings, the broken oval frame indicates the region of the sub antenna. 0 deg, 45 deg, 90 deg, and 135 deg at the lower portion of the drawings indicate the phase angle of applied high-frequency power. It is found from FIGS. 14(*a*1) to 14(*a*4) that a current is excited in the sub antenna 23 in accordance with power fed to the main antenna 21 in the case where a slit is not utilized. That is, if power is fed to the main antenna 21 in the absence of a slit, a high-frequency current flows through a GND plate 120 with a length of λ/4, which also excites a current in the sub antenna 23. This means that the two antennas are strongly coupled to each other, that is, have high correlation.

In contrast, it is found from FIGS. 14(*b*1) to 14(*b*4) that a current does not flow through the sub antenna 23 even if power is fed to the main antenna 21 in the case where a slit is utilized. If power is fed to the main antenna 21 in the presence of a slit, the slit antenna with a slit length of λ/2 resonates to produce a standing wave in the slit antenna, which does not excite a current in the sub antenna 23. This means that the two antennas are weakly coupled to each other, that is, have low correlation.

For a portable terminal with the slit 12 shown in FIG. 15(*a*), FIGS. 15(*b*1) and 15(*b*2) show a radiation pattern as seen from the front surface and the side surface, respectively, of the portable terminal in the case where power at 740 MHz is fed to the sub antenna 23 (top). Likewise, FIGS. 15(*c*1) and 15(*c*2) show a radiation pattern as seen from the front surface and the side surface, respectively, of the portable terminal in the case where power at 740 MHz is fed to the main antenna 21 (bottom). In the drawings, the intensity of the three-dimensional radiation patterns is represented by light and shade. The radiation patterns have a doughnut-like three-dimensional shape with the longitudinal direction of the portable terminal serving as the center axis. Comparing FIG. 15(*b*2) and a predetermined slit in FIG. 15(*c*2), in particular, it is found that the axis 41 of the radiation pattern of the main antenna 21 and the axis 42 of the radiation pattern of the sub antenna 23 are inclined with respect to each other. This means that the correlation between the two antennas is low.

Figure 16A:
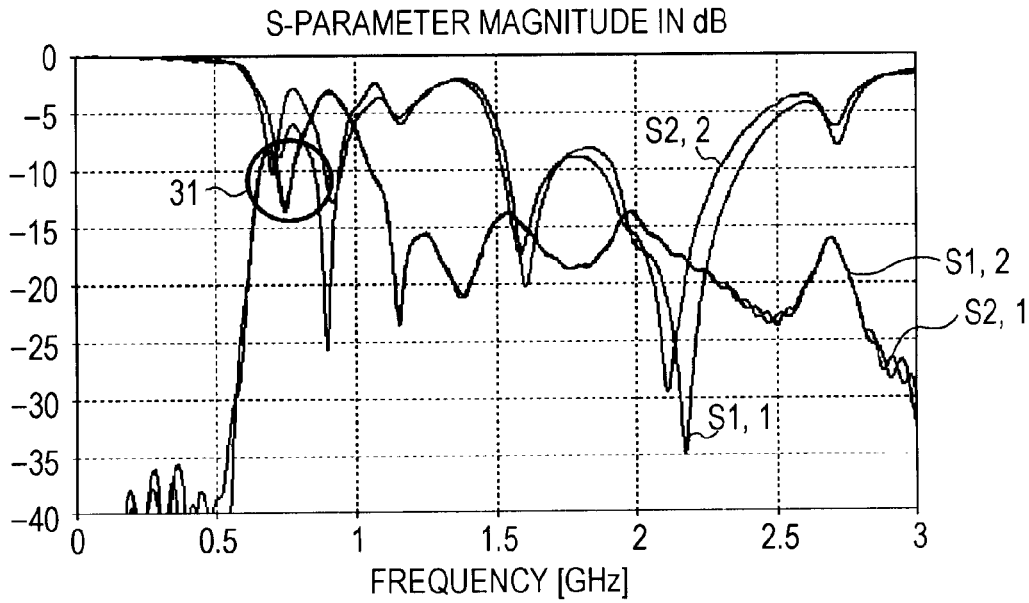
FIGS. 16(*a*) and 16(*b*) are graphs showing the frequency characteristics of the S-parameter for the antenna device of the portable terminal shown in FIG. 10.
Figure 16B:
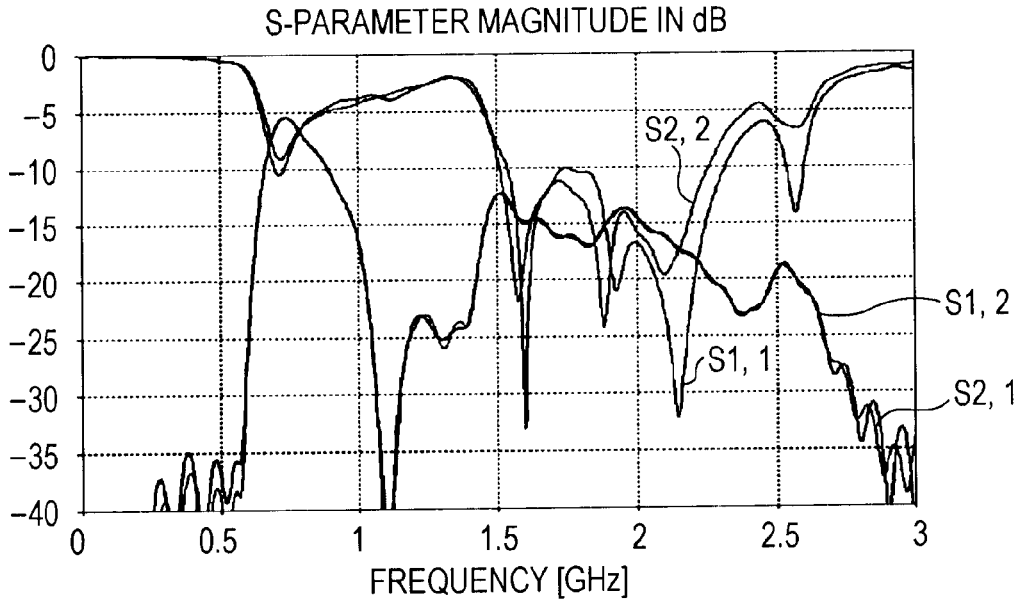
Figure 17A:
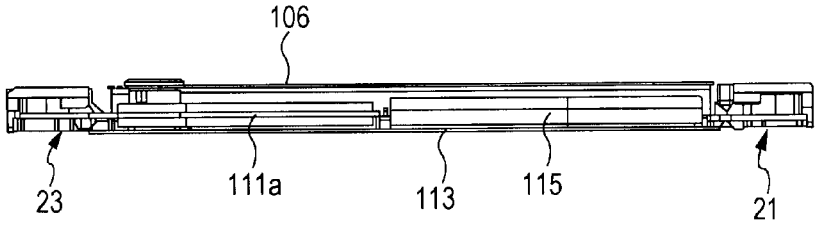
FIGS. 17(*a*) to 17(*e*) show an example of a specific configuration of a second aspect.
Figure 17B:
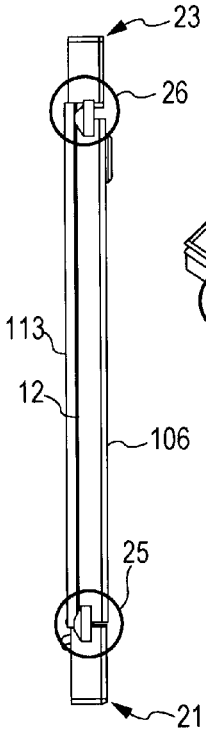
Figure 17C:
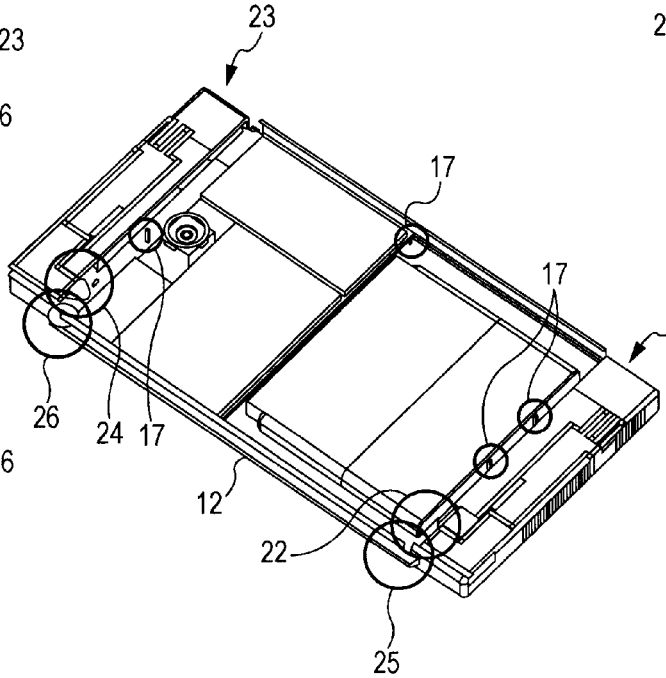
Figure 17E:
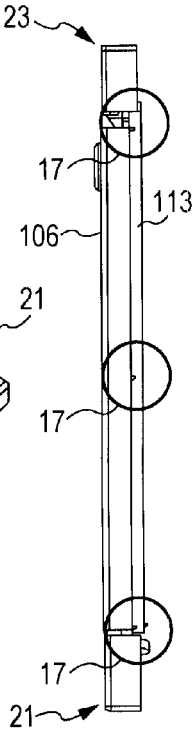
Figure 17D:
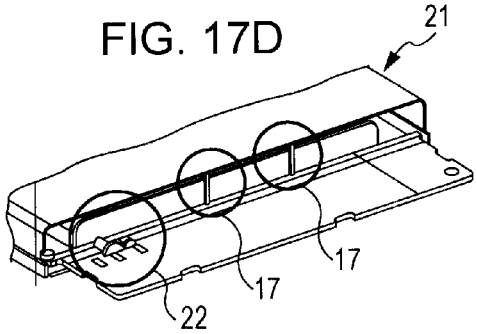

FIGS. 16(*a*) and 16(*b*) show the frequency characteristics of the S-parameter for the antenna device of the portable terminal shown in FIG. 10. In the graphs, the horizontal axis indicates the frequency [GHz], and the vertical axis indicates the value of the S-parameter [dB]. In the drawings, S1,1 indicates the reflection characteristics of the main antenna 21, and S2,2 indicates the reflection characteristics of the sub antenna 23. The negative peaks at recessed portions of the waveforms S1,1 and S2,2 indicate the resonance frequencies of the respective antenna sections.

S1,2 and S2,1 indicate the mutual transmission characteristics between the main antenna 21 and the sub antenna 23. S1,2 and S2,1 have relatively the same value, and have overlapping waveforms. Small values of S1,2 and S2,1 indicate high isolation between the two antennas, which means a low degree of correlation. It is found that the isolation between the two antennas is significantly improved locally around 700 MHz as indicated by the circular mark 31 in FIG. 16. Such high isolation between the two antennas leads to a small correlation coefficient.

Figure 18A:
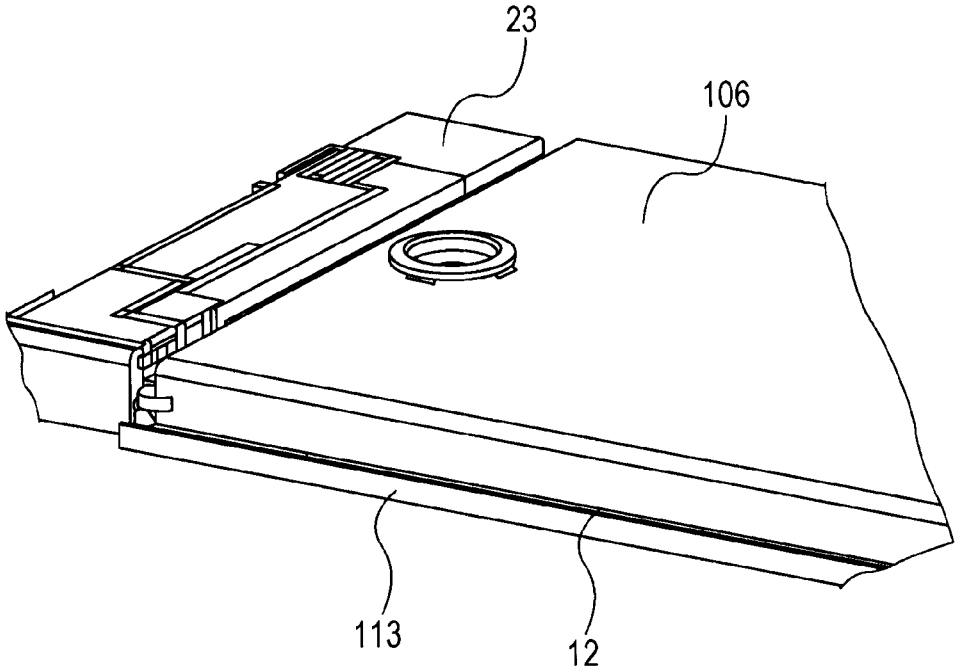
FIG. 18(*a*) is a perspective view of an essential portion of the portable terminal according to the second aspect as seen from the left side surface, and FIG. 18(*b*) is a perspective view of an essential portion of the portable terminal with the sub antenna 23 removed as seen from the upper end side of the terminal.
Figure 18B:
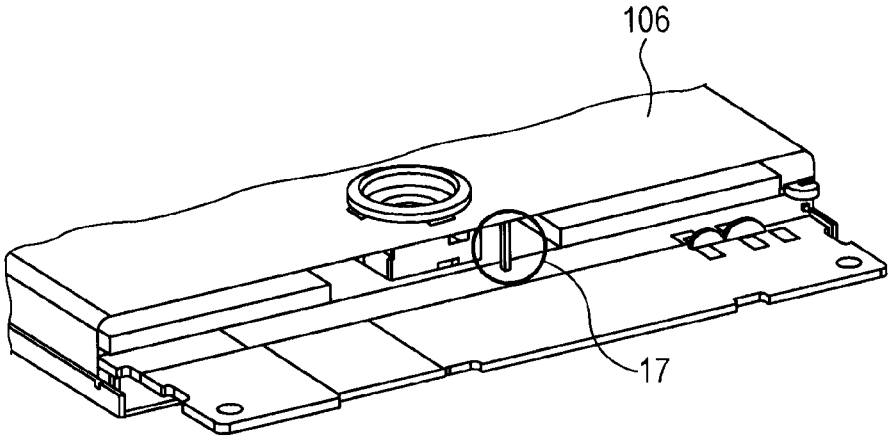
Figure 19A:
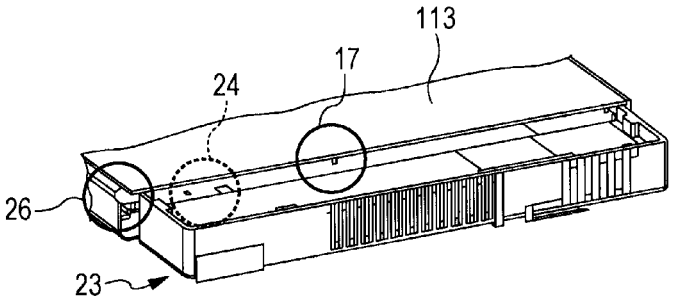
FIGS. 19(*a*) to 19(*e*) show an example of a specific configuration of a fourth aspect.
Figure 19B:
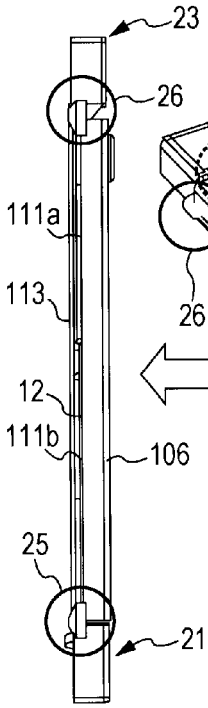
Figure 19C:
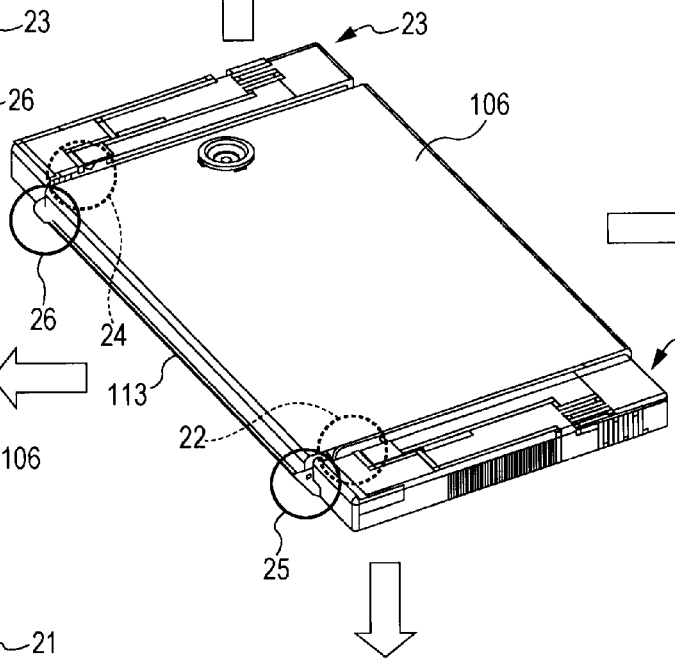
Figure 19E:
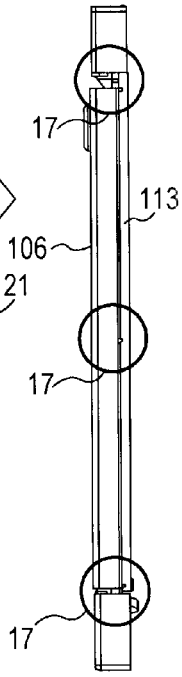
Figure 19D:
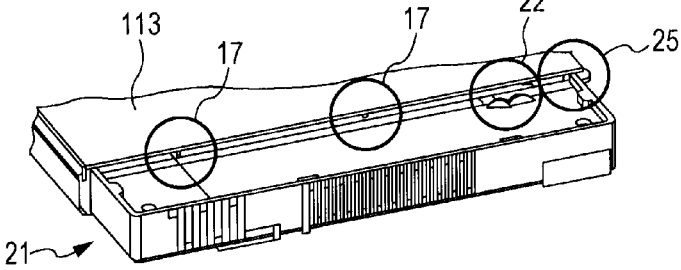

FIGS. 17(*a*) to 17(*e*) show an example of a specific configuration of the second aspect (FIG. 6(*b*)) discussed above. FIGS. 17(*c*), 17(*b*), and 17(*e*) are a perspective view, a left side view, and a right side view, respectively, of an essential portion of the portable terminal according to the second aspect. FIG. 17(*d*) is an enlarged perspective view of the main antenna portion at the lower end of the portable terminal with the main antenna 21 removed. FIG. 17(*a*) is a side cross-sectional view of the portable terminal taken along the longitudinal direction. FIGS. 17(*a*) to 17(*e*) are not to scale for convenience of illustration. Further, FIG. 18(*a*) is a perspective view of an essential portion of the portable terminal according to the second aspect as seen from the left side surface. FIG. 18(*b*) is a perspective view of an essential portion of the portable terminal with the sub antenna 23 removed as seen from the upper end side of the terminal.

In this aspect, the electrically conductive housing panel 106 is utilized as the first electrically conductive plate, and the SUS plate 113 discussed above is utilized as the second electrically conductive plate. In this aspect, the slit 12 is formed by the housing panel 106 and the SUS plate 113 therebetween. The housing panel 106 is similar to that according to the first aspect.

In this aspect, as well shown in FIG. 17(*a*), the PCB 111*a* is a so-called "half substrate" that does not extend over the entire region between the two antenna sections but that exists only on the side of one end (in this case, on the side of the sub antenna 23). In such a configuration, the PCB may not be utilized as an element forming the slit 12. On the other hand, the SUS plate 113 extends over the entire region between the two antennas, and is electrically conductive. Thus, in this aspect, the SUS plate 113 is utilized in place of the PCB as an element forming the slit 12.

Figure 20:
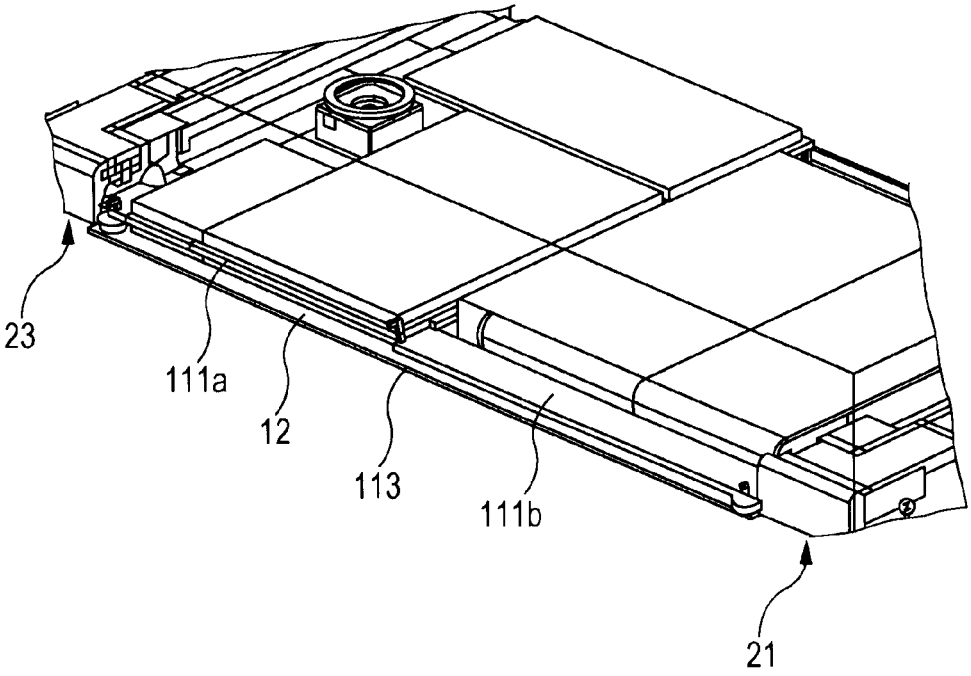
FIG. 20 is a perspective view of an essential portion of the portable terminal according to the fourth aspect as seen from the left side surface.

FIGS. 19(*a*) to 19(*e*) show an example of a specific configuration of the fourth aspect discussed above. FIGS. 19(*c*), 19(*b*), and 19(*e*) are a perspective view, a left side view, and a right side view, respectively, of an essential portion of the portable terminal according to the fourth aspect. FIG. 19(*d*) is an enlarged perspective view of the main antenna portion of the portable terminal. FIG. 19(*a*) is an enlarged perspective view of the sub antenna portion at the upper end of the portable terminal. FIGS. 19(*a*) to 19(*e*) are not to scale for convenience of illustration. Further, FIG. 20 is a perspective view of an essential portion of the portable terminal according to the fourth aspect as seen from the left side surface.

In this aspect, the electrically conductive layer (GND plate) formed in the PCB is utilized as the first electrically conductive plate, and the SUS plate 113 is utilized as the second electrically conductive plate. In this aspect, the slit 12 is formed by the PCB and the SUS plate 113 therebetween. In the example, as well shown in FIG. 20, the PCB is formed by the PCBs 111*a* and 111*b*, which are two half substrates. This corresponds to the aspect shown in FIG. 6(*d*). It should be noted, however, that the PCB may be a single full substrate that extends over the entire region between the two antenna sections. This corresponds to the third aspect shown in FIG. 6(*c*).

Figure 21A:
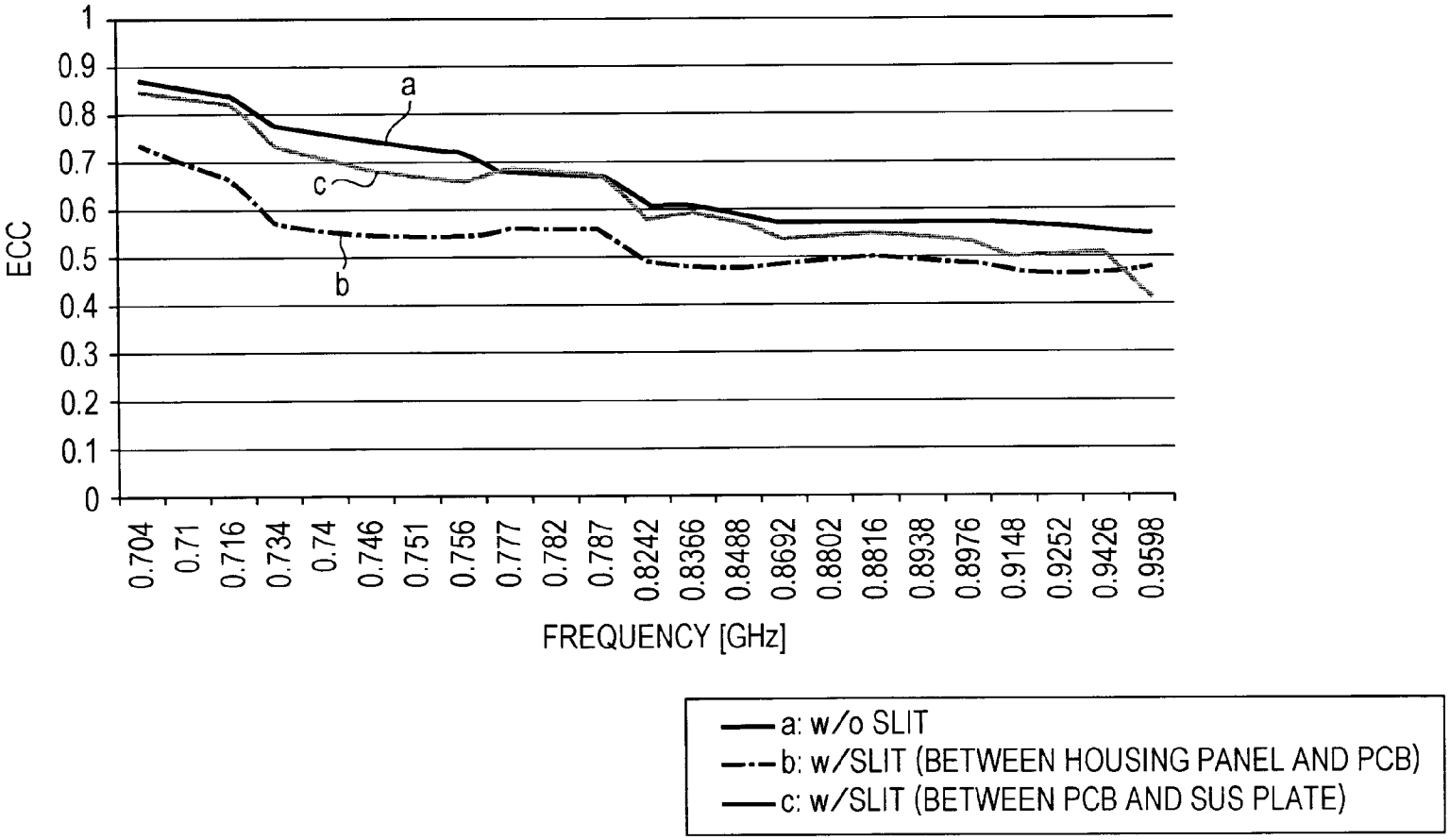
FIGS. 21(*a*) to 21(*c*) are graphs showing the frequency characteristics of the ECC, the antenna efficiency of the main antenna section (Bottom), and the antenna efficiency of the sub antenna section (Top) for a case where a slit is not utilized, a case where a slit between the housing panel and the PCB is utilized, and a case where a slit between the PCB and the SUS plate is utilized.
Figure 21B:
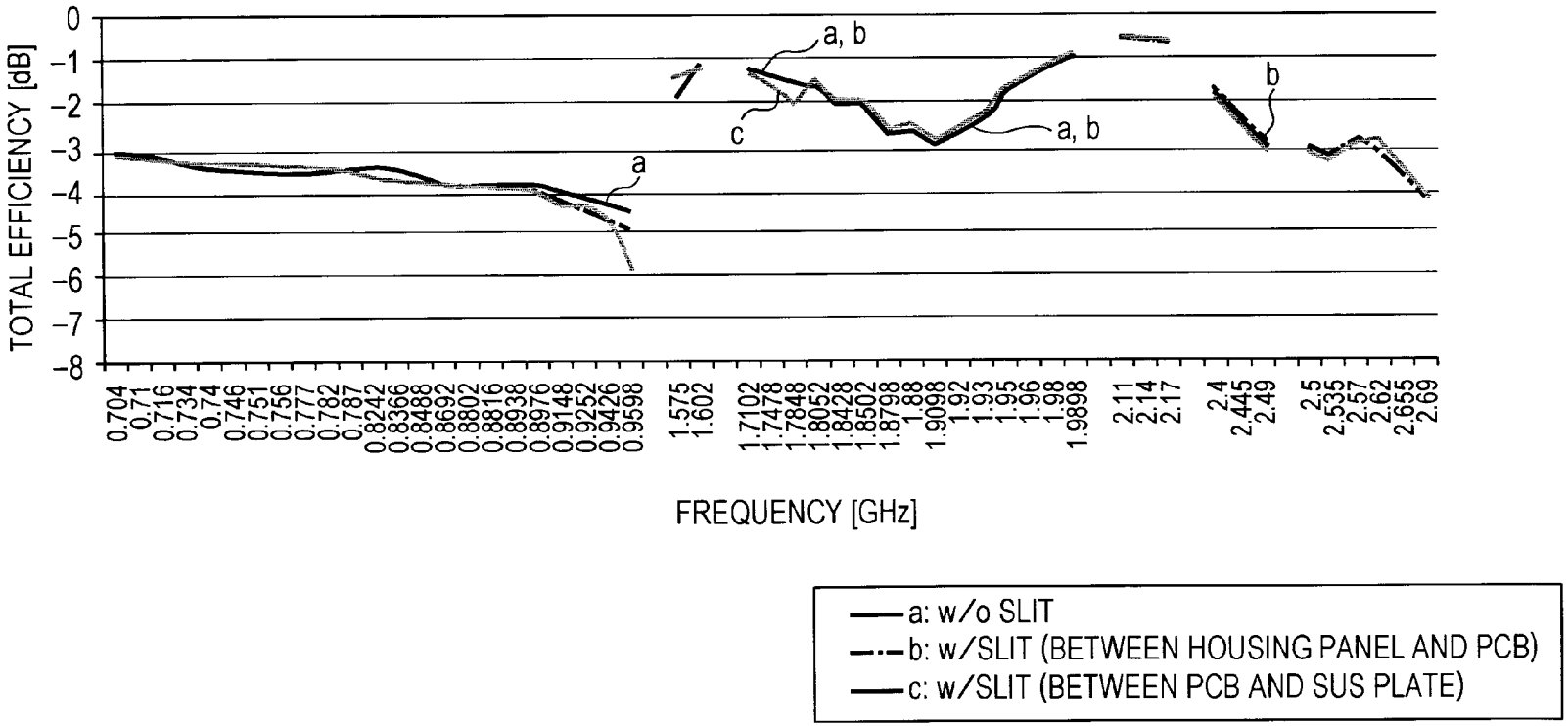
Figure 21C:
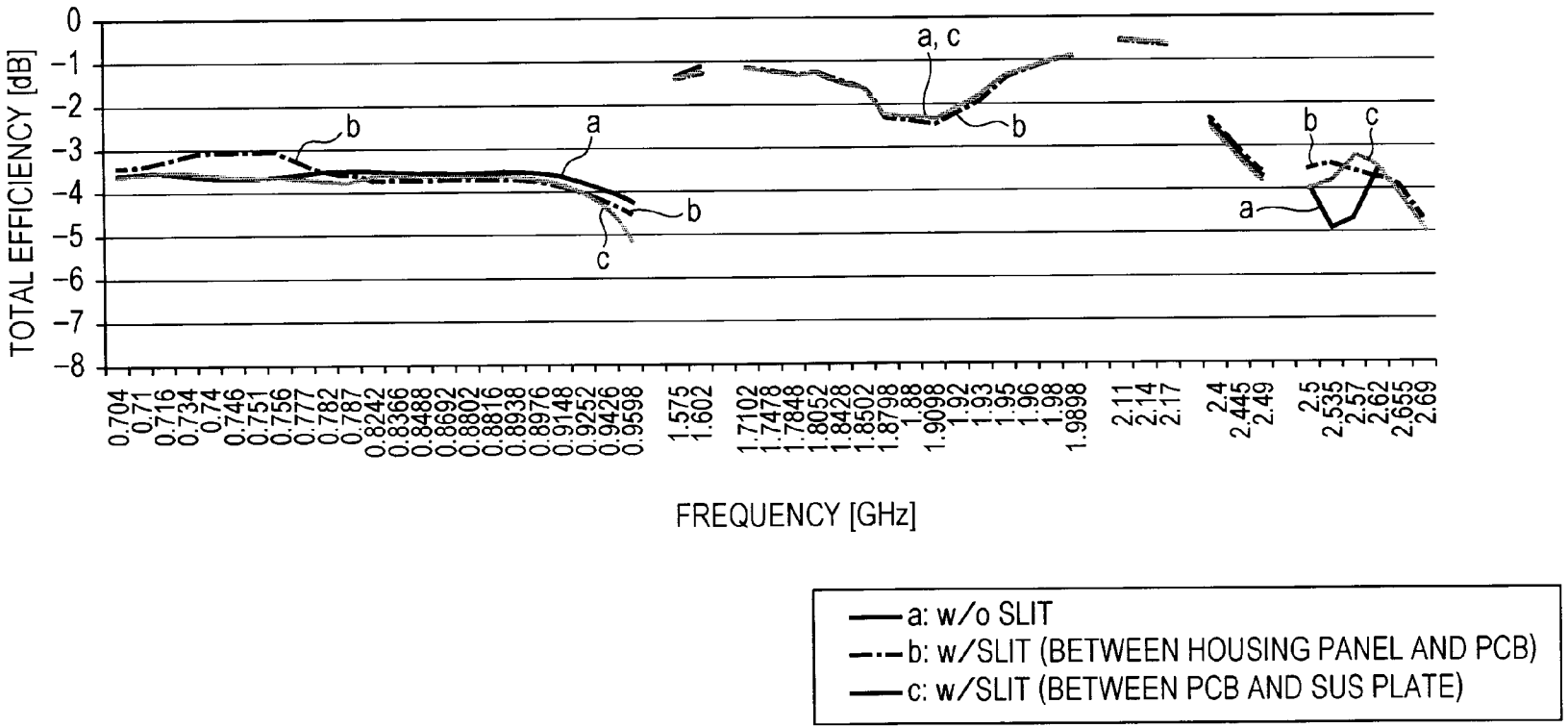

FIGS. 21(*a*) to 21(*c*) are graphs showing the frequency characteristics of the ECC, the antenna efficiency of the main antenna section (Bottom), and the antenna efficiency of the sub antenna section (Top), respectively, for a case where the slits discussed above are not utilized, a case where the slit between the housing panel and the PCB is utilized (FIG. 7(*a*)), and a case where the slit between the PCB and the SUS plate is utilized (FIG. 19).

As seen from FIG. 21(*a*), the value of the correlation coefficient, which has originally been problematic in a low-frequency band such as 700-MHz band, is reduced (that is, improved) by utilizing a slit. The degree of the improvement is particularly significant in the case where the slit between the housing panel and the PCB is utilized. As seen from FIGS. 21(*b*) and 21(*c*), the antenna efficiency (Total Efficiency) is substantially balanced between the main antenna section (Bottom) and the sub antenna section (Top), and is not particularly affected by the presence or absence of a slit.

Figure 22A:
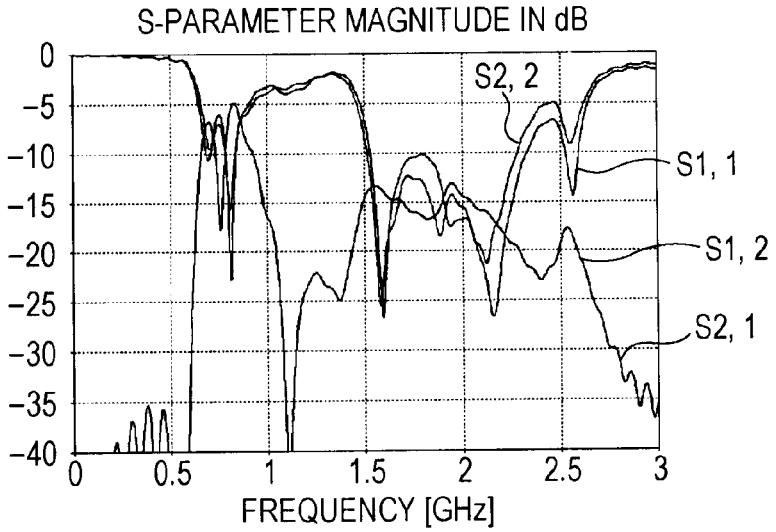
FIGS. 22(*a*) to 22(*c*) are graphs showing the antenna characteristics showing the value of the S-parameter for a case where a slit between the housing panel and the SUS plate is utilized, a case where a slit between the PCB and the SUS plate is utilized, and a case where a slit is not utilized.
Figure 22B:
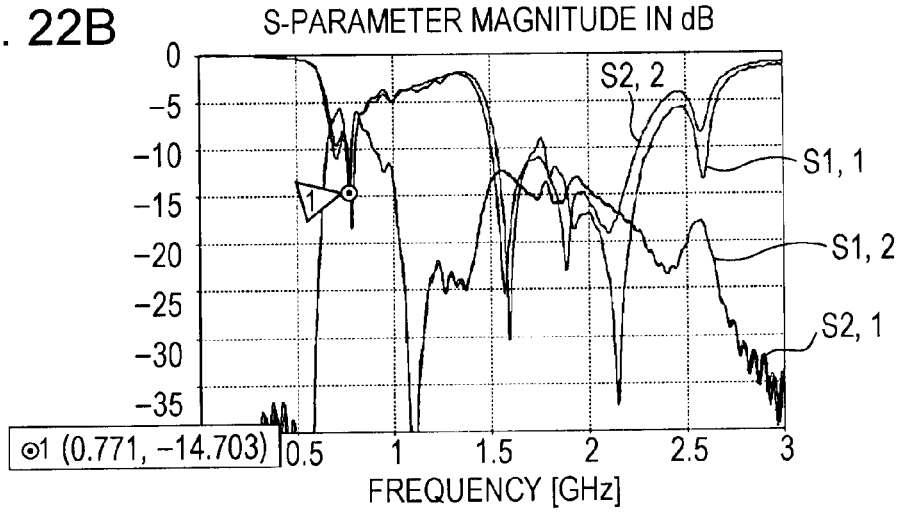
Figure 22C:
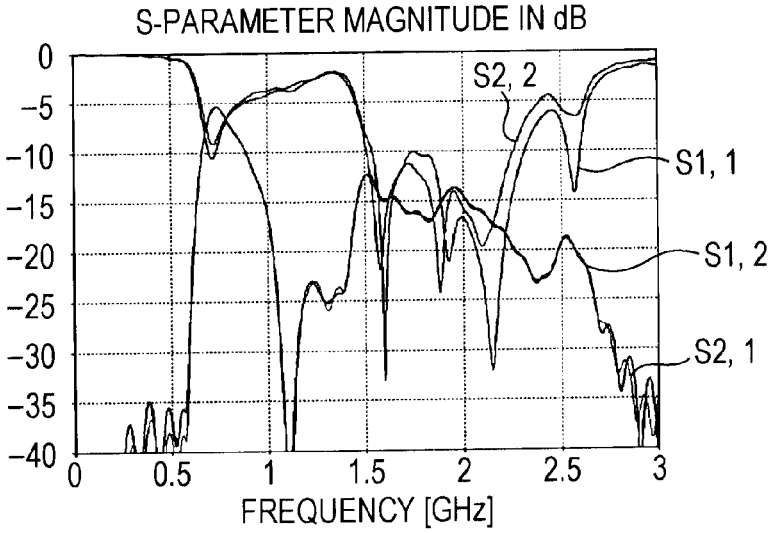

FIGS. 22(*a*) to 22(*c*) are graphs showing the antenna characteristics showing the value of the S-parameter for a case where the slit between the housing panel and the SUS plate is utilized, a case where the slit between the PCB and the SUS plate is utilized, and a case where a slit is not utilized. As discussed earlier, the parameters S1,2 and S2,1 indicate the mutual transmission characteristics, that is, the degree of isolation, between the main antenna and the sub antenna. It is found from the graphs that the isolation between the two antennas is high (that is, the correlation between the two antennas is low) around substantially 700 MHz in the case where a slit is utilized compared to a case where a slit is not utilized.

Figure 23A:
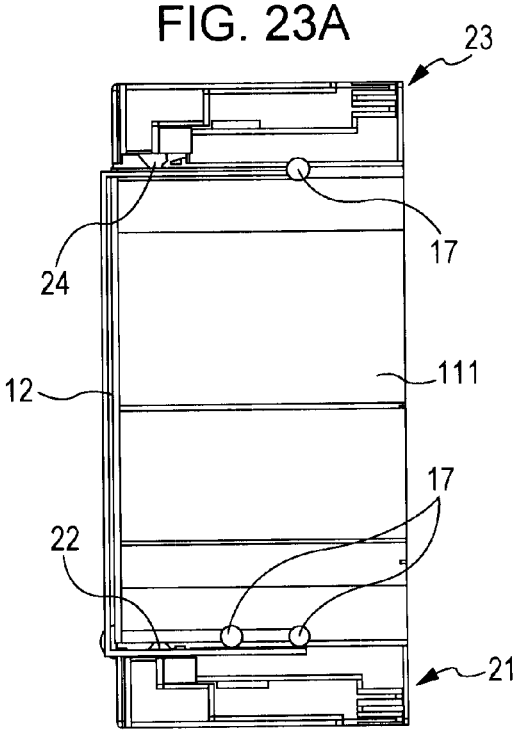
FIGS. 23(*a*) and 23(*b*) show a schematic configuration of a portable terminal according to a second embodiment of the present disclosure.
Figure 23B:
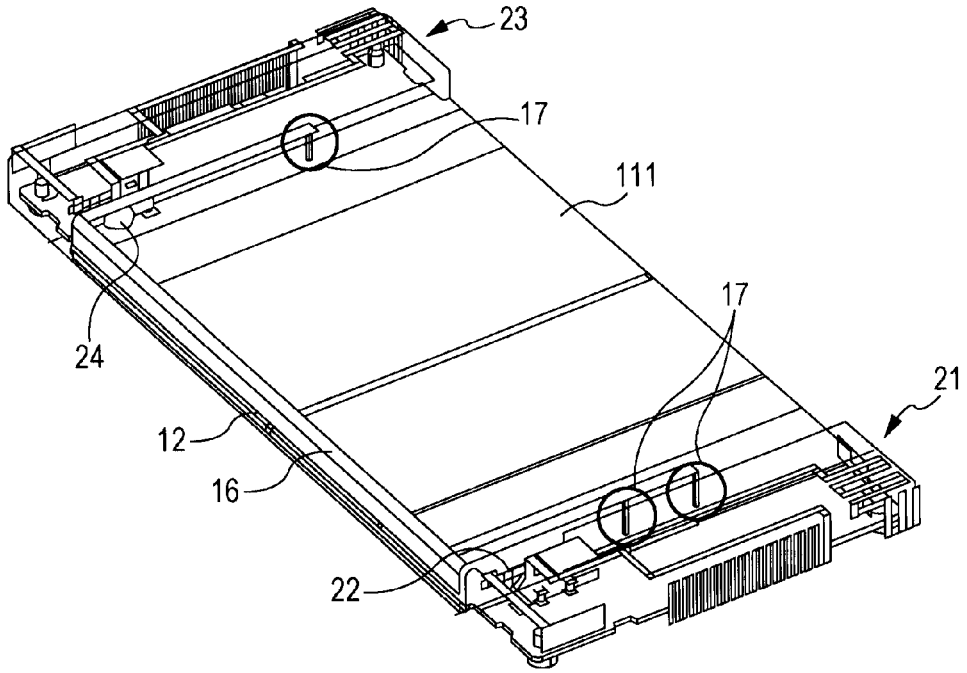

FIGS. 23(*a*) and 23(*b*) show a schematic configuration of a portable terminal according to a second embodiment of the present disclosure. In the first embodiment discussed above, the first electrically conductive plate has a relatively wide area in the main flat surface of the portable terminal. In the second embodiment, in contrast, an electrically conductive plate 16, which is an electrically conductive member disposed along the slit 12 and having the shape of a thin and long band (or a strip), is used as the first electrically conductive plate. The electrically conductive plate 16 may be provided as an element that is separate from the housing panel 106. In the case where the housing panel 106 is formed from a non-conductive material such as plastic, a band-shaped electrically conductive coating may be formed on the inside surface of the housing panel 106.

In the example shown, three short-circuiting members 17 are provided. In the second embodiment, however, at least two short-circuiting members 17 may be used to define both ends of the slit. Otherwise, the second embodiment may be configured in the same way as the first embodiment.

Figure 24A:
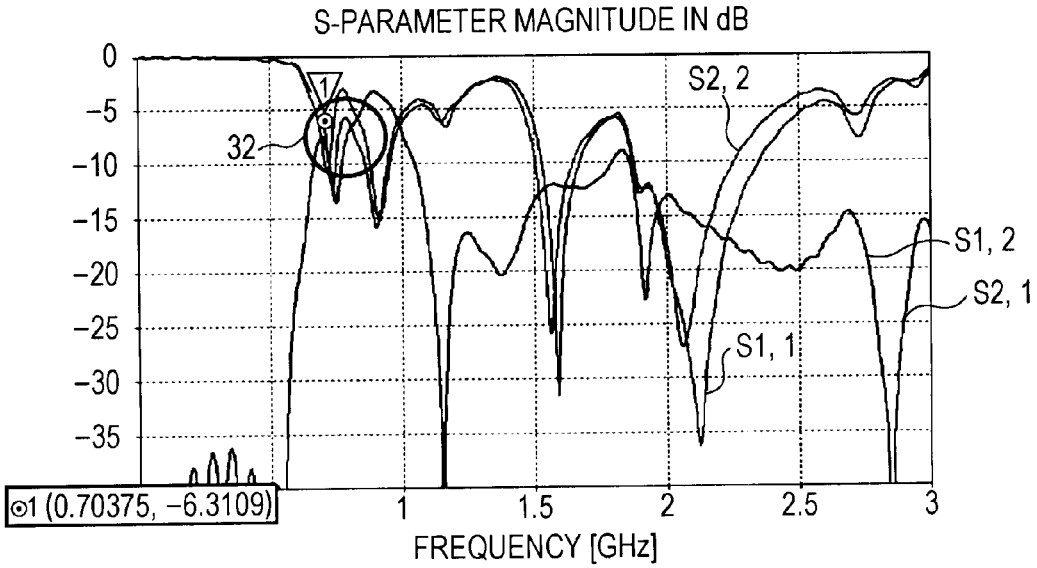
FIGS. 24(*a*) and 24(*b*) are graphs showing the frequency characteristics of the S-parameter for the antenna device of the portable terminal shown in FIGS. 23(*a*) and 23(*b*).
Figure 24B:
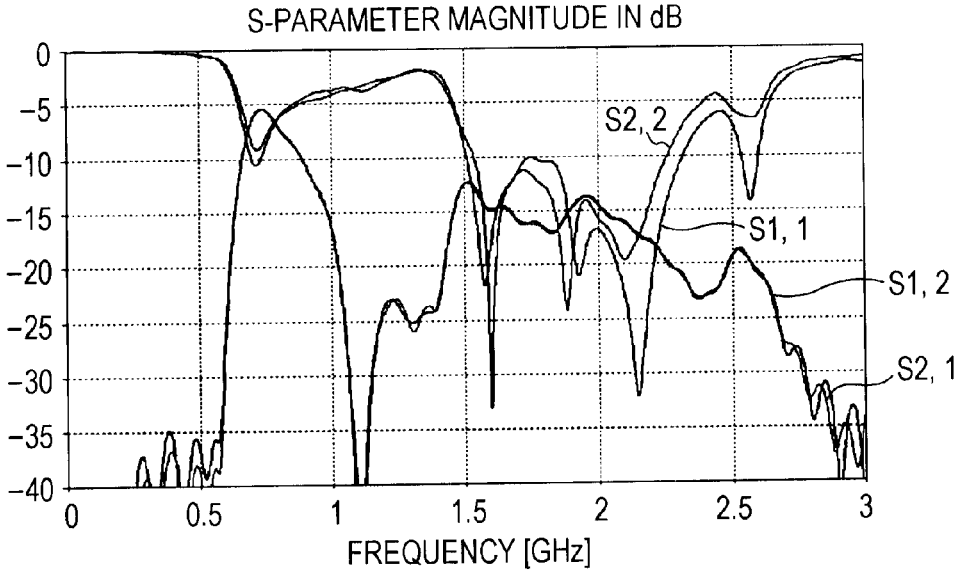

FIG. 24 shows the frequency characteristics of the S-parameter for the antenna device of the portable terminal shown in FIGS. 23(*a*) and 23(*b*). It is found that the isolation between the two antennas is significantly improved locally around 700 MHz as indicated by the circular mark 32 in FIG. 24. Such high isolation leads to a small correlation coefficient.

Figure 25A:
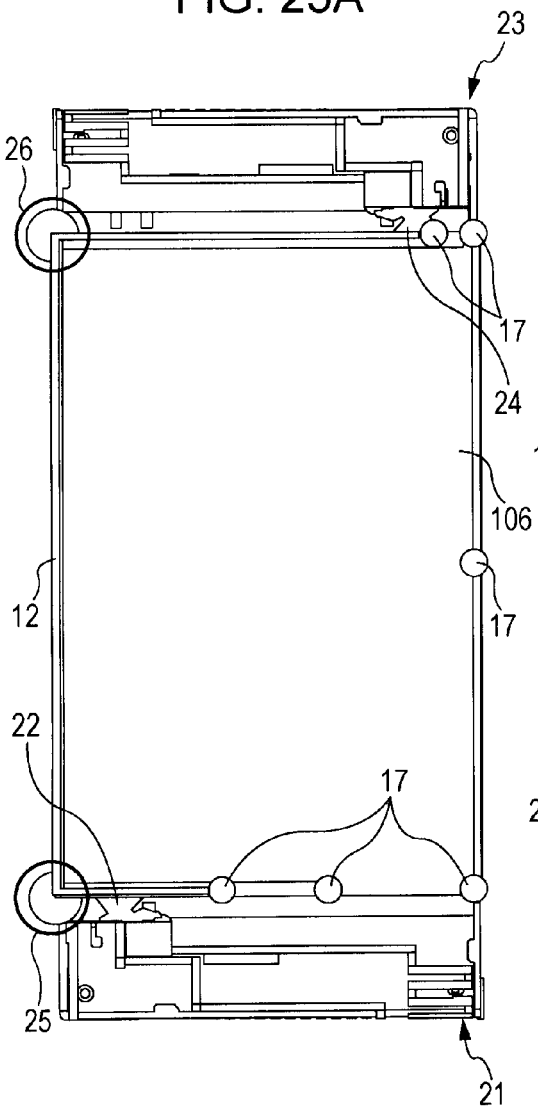
FIGS. 25(*a*) and 25(*b*) illustrate a modification of the present disclosure.
Figure 25B:
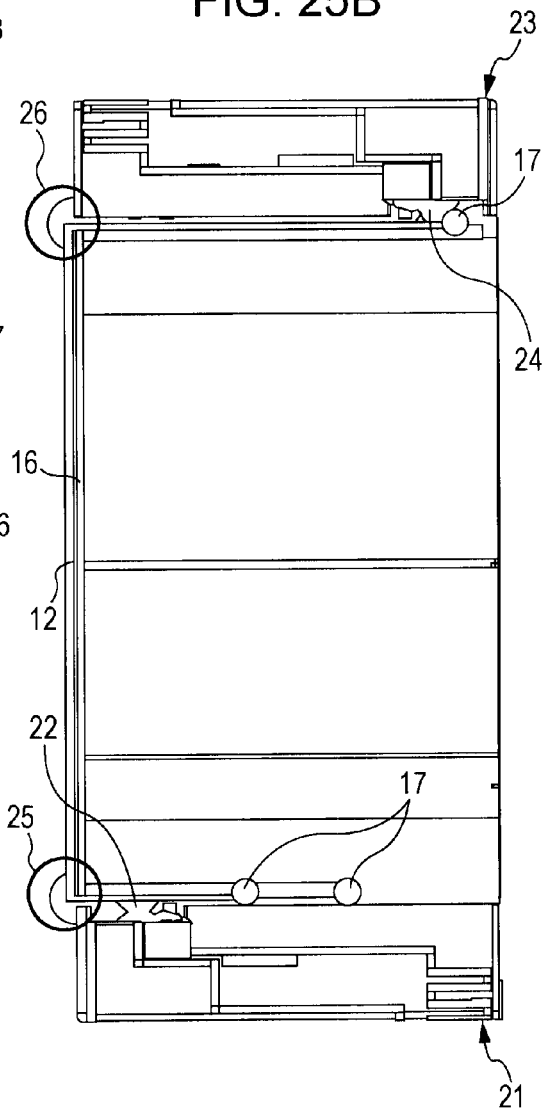

A modification of the present disclosure will be described with reference to FIGS. 25(*a*) and 25(*b*). In the above description, the respective power feed points 22, 24 for the main antenna 21 and the sub antenna 23 are disposed on the same side of the portable terminal. In FIGS. 25(*a*) and 25(*b*), in contrast, the power feed point 24 for the sub antenna 23 is disposed on the opposite side with respect to the power feed point 24 for the main antenna 21. FIG. 25(*a*) shows an example in which the housing panel 106 is utilized as the first electrically conductive plate as illustrated in relation to the first embodiment. FIG. 25(*b*) shows an example in which the band-shaped electrically conductive plate 16 is utilized as the first electrically conductive plate as illustrated in relation to the second embodiment. In either case, it is desirable that the two power feed points should be positioned between both ends of the slit 12.

Figure 26A:
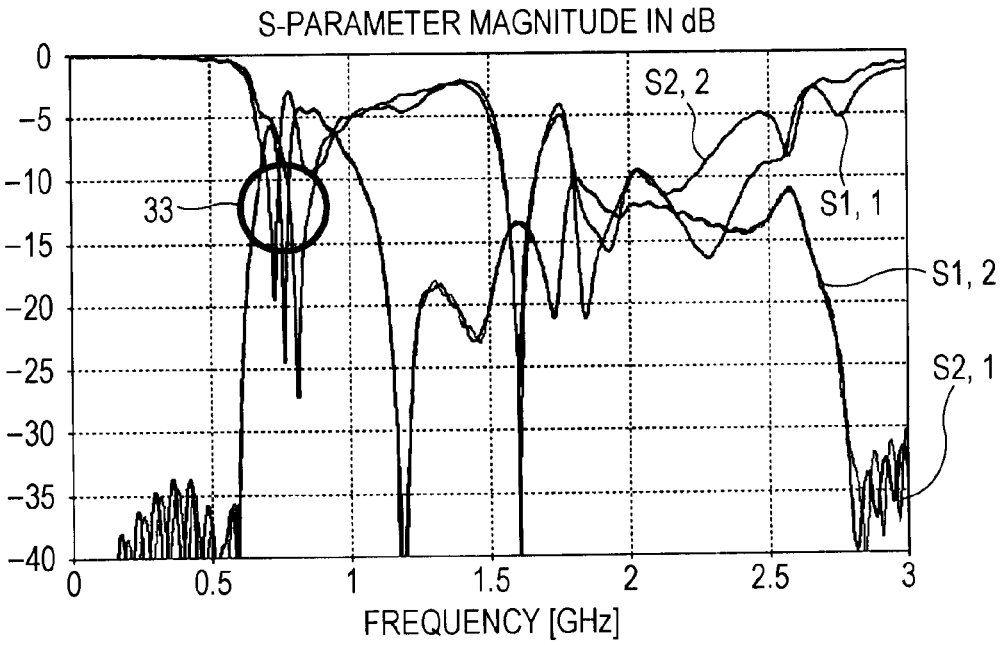
FIGS. 26(*a*) and 26(*b*) are graphs showing the frequency characteristics of the S-parameter for the antenna device of the portable terminal shown in FIGS. 25(*a*) and 25(*b*).
Figure 26B:
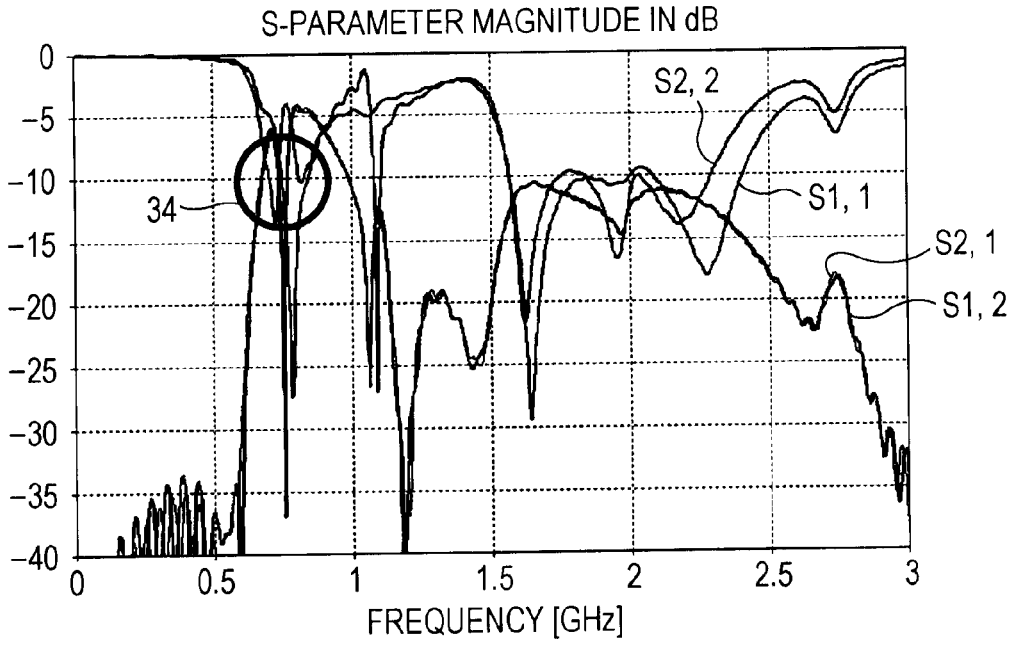

FIG. 26(*a*) shows the frequency characteristics of the S-parameter for the antenna device of the portable terminal shown in FIG. 25(*b*). It is found that the isolation between the two antennas is significantly improved locally around 700 MHz as indicated by the circular mark 33 in FIG. 26(*a*). Such high isolation leads to a small correlation coefficient.

FIG. 26(*b*) shows the frequency characteristics of the S-parameter for the antenna device of the portable terminal shown in FIG. 25(*a*). It is found that the isolation between the two antennas is significantly improved locally around 700 MHz as indicated by the circular mark 34 in FIG. 26. Such high isolation leads to a small correlation coefficient.

Figure 27:
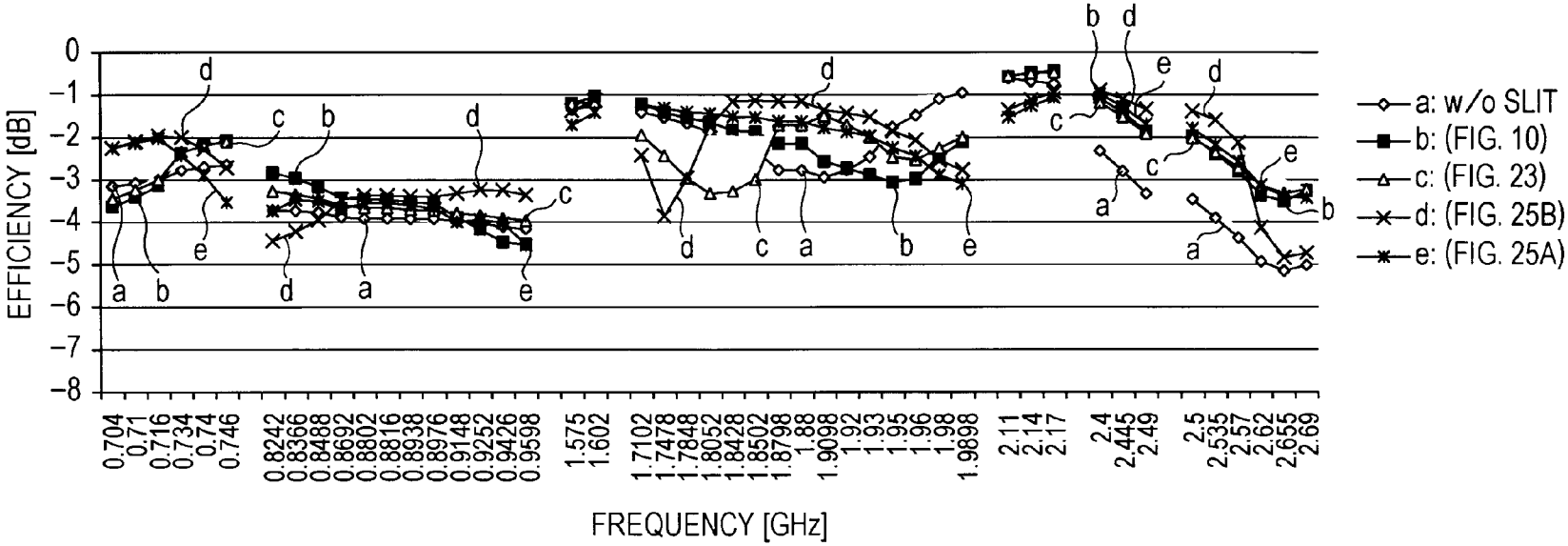
FIG. 27 is a graph showing the frequency characteristics of the efficiency of the main antenna for the variety of models of antenna device according to the embodiments of the present disclosure.
Figure 28:
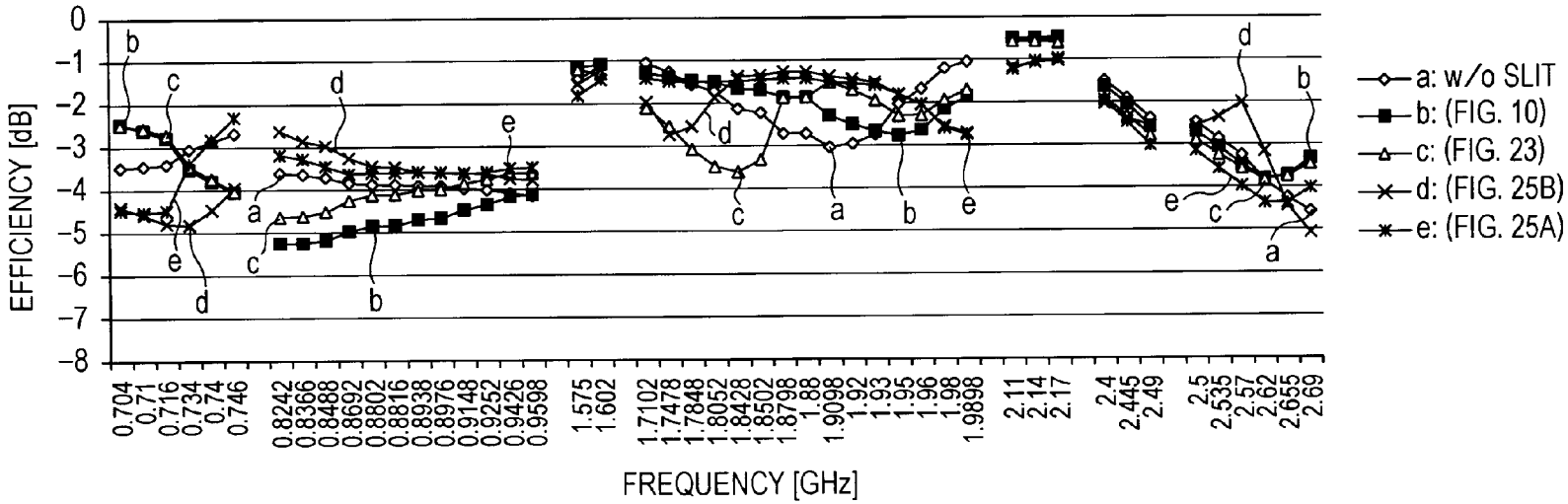
FIG. 28 is a graph showing the frequency characteristics of the efficiency of the sub antenna for the variety of models of antenna device according to the embodiments of the present disclosure.

FIG. 27 is a graph showing the frequency characteristics of the efficiency of the main antenna 21 for the variety of models of antenna device discussed above. FIG. 28 is a graph showing the frequency characteristics of the efficiency of the sub antenna 23 for the antenna devices with the variety of configurations discussed above. In the drawings, the graph a corresponds to the model without a slit, the graph b corresponds to the model shown in FIG. 10, and the graph c corresponds to the model shown in FIG. 23. In addition, the graph d corresponds to the model shown in FIG. 25(*b*), and the graph e corresponds to the model shown in FIG. 25(*a*). For both the main antenna and the sub antenna, the efficiency fluctuates among the models, but is not particularly degraded.

Figure 29:
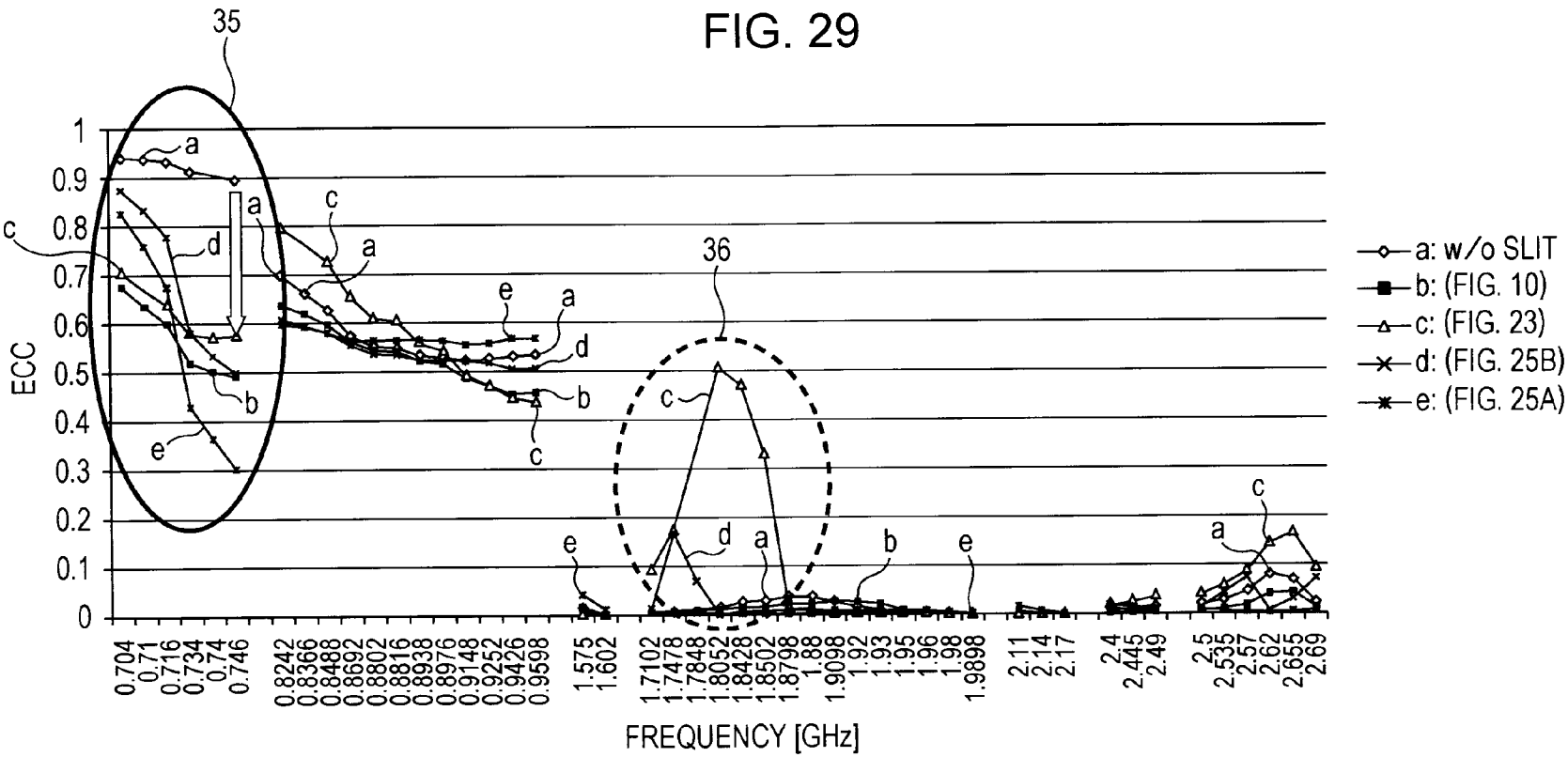
FIG. 29 is a graph showing the frequency characteristics of the envelope correlation coefficient (ECC) for the variety of models of antenna device discussed above.

FIG. 29 is a graph showing the frequency characteristics of the envelope correlation coefficient (ECC) for the variety of models of antenna device discussed above. As indicated by the solid oval 35 in the drawing, the ECC value in intended 700-MHz band is remarkably improved for the models b to e which utilize a slit, compared to the model a which does not utilize a slit. As indicated by the broken oval 36, the ECC value for the model c is relatively degraded compared to the model a around 1.8 GHz. As seen through a comparison with the ECC value in 700-MHz band, however, the absolute ECC value around 1.8 GHz itself is not so large, and not specifically problematic.

According to the embodiments of the present disclosure discussed above, there may be provided an antenna device in which a plurality of antennas have a low degree of correlation and a balanced antenna efficiency.

As has been described above, the embodiments of the present disclosure provide (1) a wireless communication apparatus comprising: a first antenna section having a first power feed point; a second antenna section having a second power feed point; a first electrically conductive plate extending between the first antenna section and the second antenna section; a second electrically conductive plate disposed substantially in parallel with the first electrically conductive plate and extending between the first antenna section and the second antenna section; and a short-circuiting member that electrically short-circuits the first electrically conductive plate and the second electrically conductive plate to each other such that a slit is formed by a part of a periphery of the first electrically conductive plate and a part of a periphery of the second electrically conductive plate.

(2) The wireless communication apparatus of (1), wherein the first antenna section and the second antenna section are disposed apart from one another by a predetermined distance.

(3) The wireless communication apparatus of (1) or (2), further comprising: a rectangular shaped housing, wherein the first antenna section is disposed at a first lengthwise end of the housing and the second antenna section is disposed at a second lengthwise end of the housing.

(4) The wireless communication apparatus of any one of (1) to (3), wherein the slit is formed between the first and antenna section and the second antenna section and extends along a periphery of a lengthwise side of the housing.

(5) The wireless communication apparatus of any one of (1) to (4), wherein the first power feed point and the second power feed point are disposed in the vicinity of the slit.

(6) The wireless communication apparatus of any one of (1) to (5), wherein the short-circuiting member comprises a plurality of electrically conductive members.

(7) The wireless communication apparatus of (6), wherein the plurality of electrically conductive members are a plurality of electrically conductive pins.

(8) The wireless communication apparatus of (6) or (7), wherein the plurality of electrically conductive members are disposed at predetermined intervals along the peripheries of the first and second electrically conductive plates other than in a region of the slit.

(9) The wireless communication apparatus of any one of (1) to (8), wherein the short-circuiting member comprises a third electrically conductive plate.

(10) The wireless communication apparatus of any one of (1) to (9), wherein the first electrically conductive plate includes an electrically conductive housing panel of the wireless communication apparatus.

(11) The wireless communication apparatus of any one of (1) to (10), wherein the first electrically conductive plate includes a ground plate.

(12) The wireless communication apparatus of any one of (1) to (11), wherein the first electrically conductive plate includes a plurality of ground plates connected to one another.

(13) The wireless communication apparatus of any one of (1) to (12), wherein the second electrically conductive panel includes a ground plate.

(14) The wireless communication apparatus of any one of (1) to (13), wherein the second electrically conductive panel includes a printed circuit board of the wireless communication apparatus.

(15) The wireless communication apparatus of any one of (1) to (14), wherein the second electrically conductive panel includes a metal plate that reinforces a display panel of the wireless communication apparatus.

(16) The wireless communication apparatus of any one of (1) to (15), wherein the second electrically conductive plate includes an electrically conductive housing panel of the wireless communication apparatus.

(17) A wireless communication apparatus comprising: a first antenna section having a first power feed point; a second antenna section having a second power feed point; a first electrically conductive plate extending between the first antenna section and the second antenna section; a second electrically conductive plate disposed substantially in parallel with the first electrically conductive plate and extending between the first antenna section and the second antenna section; and means for electrically short-circuiting the first electrically conductive plate and the second electrically conductive plate to each other such that a slit is formed by a part of a periphery of the first electrically conductive plate and a part of a periphery of the second electrically conductive plate.

In the wireless communication apparatus described above, the first and second antenna sections may form a MIMO antenna device.

While preferred embodiments of the present disclosure have been described above, various changes and modifications other than those mentioned above may be made. That is, it should be understood as a matter of course by those skilled in the art that various modifications, combinations, and other embodiments may occur depending on design requirements and other factors insofar as they are within the scope of the appended claims or the equivalents thereof.

For example, although the wireless communication apparatus shown in the drawings is a so-called straight type, the present disclosure may be applied to other types of wireless communication apparatuses, such as a folding type and a sliding type.

The invention claimed is:

1. A wireless communication apparatus comprising:

a first antenna section having a first power feed point;

a second antenna section having a second power feed point;

a rectangular shaped housing, wherein the first antenna section is disposed at a first lengthwise end of the housing and the second antenna section is disposed at a second lengthwise end of the housing;

a rectangular shaped ground plate extending between the first antenna section and the second antenna section;

a rectangular shaped electrically conductive plate including a printed circuit board of the wireless communication apparatus and disposed substantially in parallel with the ground plate and extending between the first antenna section and the second antenna section, wherein a surface area of the ground plate and a surface area of the conductive plate are substantially the same; and a plurality of short-circuiting members that electrically short-circuit the ground plate and the conductive plate to each other such that a slit configured to function as at least one of a slit antenna and slot antenna and having a length substantially half a wavelength of a frequency used by the wireless communication apparatus is formed by a part of a periphery of the ground plate and a part of a periphery of the conductive plate between the plurality of short-circuiting members.

2. The wireless communication apparatus of claim 1, wherein the first antenna section and the second antenna section are disposed apart from one another by a predetermined distance.

3. The wireless communication apparatus of claim 1, wherein the slit is formed between the first antenna section and the second antenna section and extends along a periphery of a lengthwise side of the housing.

4. The wireless communication apparatus of claim 1, wherein the first power feed point and the second power feed point are disposed in the vicinity of the slit.

5. The wireless communication apparatus of claim 1, wherein the plurality of short-circuiting members are electrically conductive members.

6. The wireless communication apparatus of claim 5, wherein the plurality of electrically conductive members are a plurality of electrically conductive pins.

7. The wireless communication apparatus of claim 1, wherein the short-circuiting member comprises a second conductive plate.

8. The wireless communication apparatus of claim 1, wherein the ground plate includes an electrically conductive housing panel of the wireless communication apparatus.

9. The wireless communication apparatus of claim 1, wherein the electrically conductive plate includes a metal plate that reinforces a display panel of the wireless communication apparatus.

10. The wireless communication apparatus of claim 1, wherein the electrically conductive plate includes an electrically conductive housing panel of the wireless communication apparatus.

11. A wireless communication apparatus comprising:

a first antenna section having a first power feed point;

a second antenna section having a second power feed point;

a rectangular shaped housing, wherein the first antenna section is disposed at a first lengthwise end of the housing and the second antenna section is disposed at a second lengthwise end of the housing;

a rectangular shaped ground plate extending between the first antenna section and the second antenna section;

a rectangular shaped electrically conductive plate including a printed circuit board of the wireless communication apparatus and disposed substantially in parallel with the ground plate and extending between the first antenna section and the second antenna section, wherein a surface area of the ground plate and a surface area of the conductive plate are substantially the same; and means for electrically short-circuiting the ground plate and the conductive plate to each other such that a slit configured to function as at least one of a slit antenna and slot antenna and having a length substantially half a wavelength of a frequency used by the wireless communication apparatus is formed by a part of a periphery of the ground plate and a part of a periphery of the conductive plate.

* * * * *